US007625683B2

(12) United States Patent
Tokutake et al.

(10) Patent No.: US 7,625,683 B2
(45) **Date of Patent: *Dec. 1, 2009**

(54) IMAGE FORMING METHOD, A PROCESSING CARTRIDGE AND AN IMAGE FORMING METHOD USING THE SAME

(75) Inventors: Shigeaki Tokutake, Hachioji (JP); Masao Asano, Tokyo (JP); Keiichi Inagaki, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 399 days.

This patent is subject to a terminal disclaimer.

(21) Appl. No.: 11/174,325

(22) Filed: Jul. 1, 2005

(65) Prior Publication Data

US 2007/0003848 A1 Jan. 4, 2007

(51) Int. Cl.
*G03G 15/01* (2006.01)

(52) U.S. Cl. ..... 430/97; 399/200

(58) Field of Classification Search ..... 430/97; 399/220

See application file for complete search history.

(56) References Cited

U.S. PATENT DOCUMENTS

| | | | | |
|---|---|---|---|---|
| 5,677,031 | A * | 10/1997 | Allan et al. | 428/137 |
| 6,964,834 | B2 * | 11/2005 | Ueda et al. | 430/59.6 |
| 7,022,450 | B2 | 4/2006 | Asano et al. | |
| 7,071,962 | B2 * | 7/2006 | Fujii et al. | 347/248 |
| 7,261,991 | B2 * | 8/2007 | Yoshizawa et al. | 430/125.3 |
| 7,378,212 | B2 * | 5/2008 | Inagaki et al. | 430/120.1 |
| 2003/0087171 | A1 * | 5/2003 | Tokutake et al. | 430/58.2 |
| 2004/0063014 | A1 * | 4/2004 | Yoshimura et al. | 430/59.6 |
| 2004/0067428 | A1 * | 4/2004 | Itami | 430/100 |
| 2004/0147664 | A1 | 7/2004 | Lee et al. | |
| 2005/0037274 | A1 | 2/2005 | Shida et al. | |
| 2005/0186494 | A1 * | 8/2005 | Inagaki et al. | 430/66 |
| 2005/0277036 | A1 * | 12/2005 | Dinh et al. | 430/66 |
| 2006/0148971 | A1 | 7/2006 | Jing et al. | |
| 2006/0164496 | A1 * | 7/2006 | Tokutake et al. | 347/112 |
| 2006/0188798 | A1 * | 8/2006 | Tokutake et al. | 430/60 |
| 2007/0003853 | A1 | 1/2007 | Inagaki et al. | |

FOREIGN PATENT DOCUMENTS

| | | |
|---|---|---|
| JP | 07-295271 | 11/1995 |

(Continued)

OTHER PUBLICATIONS

Notice of Rejection mailed by JPO on Jan. 29, 2008, in connection with App. No. P2004-157288, 4 pgs.

(Continued)

*Primary Examiner*—Hoa V Le
(74) *Attorney, Agent, or Firm*—Squire, Sanders & Dempsey L.L.P.

(57) ABSTRACT

An image forming method is disclosed, the method includes forming a latent image by irradiating an organic photoreceptor by a semiconductor laser or a light emission diode emitting light of a wavelength of from 350 to 500 nm, and developing the latent image by a developer containing a toner to form a toner image, the organic photoreceptor having a surface layer comprising a binder and fluororesin fine particles having an average primary particle diameter of not less than 0.02 μm and less than 0.20 μm.

16 Claims, 6 Drawing Sheets

FOREIGN PATENT DOCUMENTS

| | | |
|---|---|---|
| JP | 2001/-066807 | 3/2001 |
| JP | 2002/182415 | 6/2002 |
| JP | 2003/241412 | 8/2003 |
| JP | 2003/330229 | 11/2003 |
| JP | 2004/177461 | 6/2004 |
| JP | 2004/199043 | 7/2004 |
| JP | 2004/226883 | 8/2004 |

OTHER PUBLICATIONS

Translation of Notice of Rejection mailed by JPO on Jan. 29, 2008, in connection with App. No. P2004-157288, 5 pgs.
Notice of Rejection mailed by JPO on Jan. 29, 2008, in connection with App. No. P2004-243533, 5 pgs.
Translation of Notice of Rejection mailed by JPO on Jan. 29, 2008, in connection with App. No. P2004-243533, 6 pgs.
Notice of Rejection mailed by JPO on Jan. 29, 2008, in connection with App. No. P2004-243534, 3 pgs.
Translation of Notice of Rejection mailed by JPO on Jan. 29, 2008, in connection with App. No. P2004-243534, 4 pgs.
Notice of Rejection mailed by JPO on Jan. 29, 2008, in connection with App. No. P2004-243535, 5 pgs.
Translation of Notice of Rejection mailed by JPO on Jan. 29, 2008, in connection with App. No. P2004-243535, 6 pgs.

* cited by examiner

IMAGE FORMING METHOD, A PROCESSING CARTRIDGE AND AN IMAGE FORMING METHOD USING THE SAME

TECHNICAL FIELD

The invention is relates to an image forming method employing an organic photoreceptor, a processing cartridge and an image forming method using the processing cartridge to be used in the field of copying machines and printers.

RELATED ART

Recently, organic photoreceptors, hereinafter also referred to as photoreceptor, are widely employed for electrophotographic receptors. The organic photoreceptor has advantages compared with another photoreceptor such as that materials suitable for various exposing light sources emitting various wavelength light within the range of from visible light to infrared rays can be easily developed, materials not causing environment contamination can be selected and the producing cost is low. The organic photoreceptor, however, has drawbacks such as that the mechanical strength is weak and foreign matters easily adhere onto it, the chemical durability is low so as to cause the degradation in the electrostatic property of the photoreceptor on the occasion of printing a lot of sheets and scratches occur on the surface thereof.

Consequently, the organic photoreceptor is required to have durability (anti-abrasion ability) against adhering foreign materials and the occurrence of damages on the surface thereof caused by the external force at the time of cleaning the toner remaining on the photoreceptor or transferring toner images to an image receiving material such as a paper sheet.

Hitherto, a technique has been known in which particles of fluororesin such as polytetrafluoroethylene resin (PTFE) are contained in the outermost layer of the photoreceptor for improving the resistivity of the photoreceptor against abrasion and adhering foreign material. Particularly, a technique has been reported in which fluororesin having low crystalline degree (the half band width of the peak of X-ray diffraction pattern of not less than 0.28) is employed as the means for effectively lowering the frictional coefficient so as to improving the anti-abrasion ability, for example, Japanese Patent L.O.P. Publication 8-328287.

On the other hand, an image forming apparatus and a method capable of outputting a high precision image are required for the image forming apparatus employing the organic photoreceptor for corresponding to expanding the demand for the printer as the outputting terminal of images formed by a computer. Corresponding to such the requirement, it has been proposed to form high density digital images by employing short wavelength laser light as the light source for exposure, cf. Japanese Patent L.O.P. Publication 2000-250239. When the short wavelength laser light is applied, however, the presence of the fluororesin particles in the outermost layer of the organic photoreceptor increases the scattering of the short wavelength laser light so as to cause a problem that the sharpness of the image is rather degraded.

Short wavelength LD and LED emitting purple or blue light of from 400 nm to 500 nm are supplied to the market for the image exposure light source. A latent image can be formed by a laser beam having small diameter by the use of such the short wavelength light source. However, the laser light beam is scattered in the organic photoreceptor and independently dots cannot be formed on the photoreceptor and the improving effects in the sharpness and the resolution are not sufficiently displayed even when the diameter of the light spot is made small.

Particularly, it is a problem that the scattering of the laser light tends to occur in the organic photoreceptor containing the fluororesin fine particles in the surface layer thereof and the sharpness improving effect of the short wavelength laser light is not sufficiently displayed. Moreover, the dispersing stability of the fluororesin fine particles is low in the coating dispersion liquid for forming the surface layer containing the fluororesin fine particles so that coarse particles are tend to be formed by coagulation of the fluororesin fine particles. Such the coagulated particles increase the scattering of the laser light and cause difficulty of forming the surface layer having uniform property. Therefore, a problem is posed that the image quality is considerably lowered by occurrence of dash marks (comet-like shaped small line images), black and white streak lines in the electrophotographic image.

SUMMARY OF THE INVENTION

An image forming method comprising the steps of forming a latent image by irradiating an organic photoreceptor by light from a light source of a semiconductor laser or a light emission diode emitting light of a wavelength of from 350 to 500 nm, and developing the latent image by a developer containing a toner to form a toner image, and the organic photoreceptor has a surface layer comprising a binder and fluororesin fine particles having an average primary particle diameter of not less than 0.02 μm and less than 0.20 μm.

The organic photoreceptor preferably has the surface layer having a contact angle with water of not less than 90° and the absolute value of a variation of the contact angle within 2.0°.

It is preferable that the organic photoreceptor preferably has a charge generation layer and a charge transfer layer on an electroconductive substrate, and the surface layer is the charge transfer layer. The charge transfer layer is preferably composed of a plurality of charge transfer layers.

The crystallinity of the fluororesin fine particle is preferably not less than 40% and less than 90%.

DETAILED DESCRIPTION OF THE INVENTION

Figure 1:
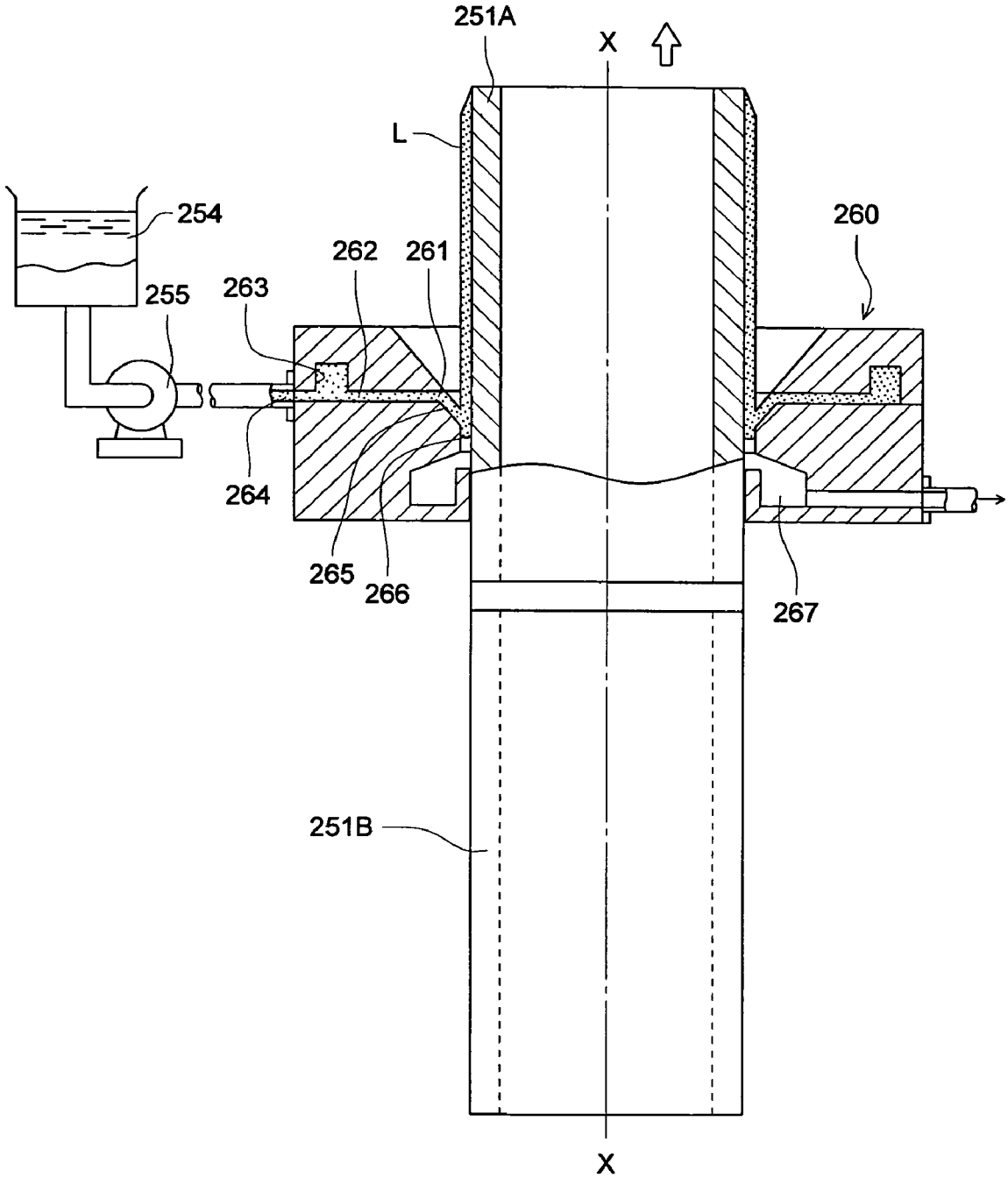
FIG. 1 shows the cross section of an example of a circular slide hopper type coating apparatus relating to the invention.

An object of the invention is to provide an image forming method for forming a high precision electrophotographic image by using an organic photoreceptor and short wavelength laser light. Another object of the invention is to provide an organic photoreceptor having a surface layer containing the fluororesin fine particles capable of forming an electrophotographic image with high sharpness in which the scattering of the short wavelength by the fluororesin fine particle is prevented and the occurrence of the dash mark, black line and white line is also prevented, and to provide a processing cartridge using the organic photoreceptor and an image forming method using the cartridge.

The inventors have found and attained the invention as a result of their investigation on the above-described problems that to make small the diameter of the fluororesin fine particles and to improve the dispersing status of the fluororesin fine particles in the surface layer to form a surface layer having uniform surface energy are effectual for preventing the scattering of the short wavelength laser light and occurrence of the dash marks, black lines and white lines. Particularly, it is found that the surface layer having the uniform surface energy can be formed by improving the dispersing ability of the fluororesin fine particles having low crystallinity and small diameter. The surface layer uniformly having low surface energy can be formed by making uniform the dispersing status of the fluororesin fine particles in the coating dispersion liquid and applying a coating method by which the coating dispersion liquid can be completely used before the formation of the coagulated particles.

The image forming method comprises forming the latent image by irradiating an organic photoreceptor having a surface layer containing fluororesin fine particles having an average primary particle diameter of not less than 0.02 μm and less than 0.20 μm by light from a light source of a semiconductor laser or a light emission diode emitting light of a wavelength of from 350 to 500 nm.

The organic photoreceptor employed in the above image forming method preferably has the surface layer having a contact angle of not less than 90° and an absolute value of a variation of the contact angle within 2.0°.

According to the above-mentioned, the scattering of the short wavelength laser light by the photoreceptor having the surface layer containing the fluororesin fine particles can be prevented and the occurrence of the dash marks, black lines and white lines can be also prevented so as to be able to form the electrophotographic layer with high sharpness.

The fluororesin fine particle is employed in the invention. The fluororesin fine particles having an average primary particle diameter of from 0.02 to 0.2 μm are preferable since the coagulation of the fluororesin fine particles with together is prevented so as to be able to obtain a uniform and stable dispersion and the variation of the contact angle of the surface is small. In such the constitution, the occurrence of the dash mark can be inhibited and the degradation in the sharpness caused by the scattering of the imagewise exposure by the short wavelength laser light can be prevented. The average primary particle diameter is preferably from 0.02 to 0.18 μm.

The average diameter of the primary particles measured by DSL-6000, Ootsuka Denshi Co., Lit., utilizing the dynamic light scattering method is described in the present specification. The measurement by observing the cross section of the photosensitive layer may be applied if the measurement the same as that by the above-mentioned apparatus can be carried out. The contact angle of the surface layer with water is preferably not less than 90° for preventing adhesion of the external additive in the toner such as silica to the surface of the photoreceptor, inhibiting the occurrence of the dash mark, and lowering the frictional resistivity between the member contacting with photoreceptor surface such as the cleaning blade so as to inhibit the abrasion by rubbing for inhibiting the degradation in the sharpness and the occurrence of the line shaped unevenness of the image. The contact angle of from 95° to 120° is more preferable for obtaining sufficient hardness and inhibiting the occurrence of the scratches and blurring of image. The variation absolute value of the contact angle of the surface layer is preferably less than 0.2° for inhibiting the scattering of the imagewise exposing light such as the short wavelength laser light by uniformly dispersing the fluororesin fine particles in the surface layer and for preventing the burying of an inorganic external additive such as silica and titanium oxide in the toner and talk in the paper powder into the surface layer of the photoreceptor so as to prevent the occurrence of the dash mark, black line and white line. The absolute value of the contact angle is more preferably within 1.7°.

Measurement of the Contact Angle and the Variation Thereof

The contact angle of the photoreceptor with purified water is measured by a CA-DT•A type contact angle meter, manufactured by Interface Science Co., Ltd., at 20° C. and 50% RH.

The variation of the contact angle is measured as to the photoreceptor sufficiently fitted to image forming condition (at least after printing of some sheets of print). When the photoreceptor is cylindrical, the measurement is carried out at 4 points each parted for 90° in the circumference direction on each of three lines being at the center and at a distance of 5 cm from the both ends of the photoreceptor, therefore, the sum of the measuring point becomes 12. The average of the values measured at the 12 points is defined as the contact angle according to the invention, and the largest value being positively or negatively off from the average value is defined as the variation of the contact angle. When the photoreceptor is a sheet, the measurement is carried out at 4 points each parted in equal distance on each of three lines being at the center and at a distance of 5 cm from the both ends of the photoreceptor, therefore, the sum of the measuring point becomes 12. The average of the values measured at the 12 points is defined as the contact angle according to the invention, and the largest value being positively or negatively off from the average value is defined as the variation of the contact angle.

The crystallinity of the fluororesin fine particle is preferably not less than 40% and less than 90%. When the crystallinity is in the above range, the preferable dispersing ability of the fluororesin fine particles and the spreading ability of the fluororesin fine particles themselves can be obtained so that the suitable variation of the contact angle is obtained.

The crystallinity of the fluororesin fine particle is measured by separating the diffraction peaks obtained by wide angle X-ray diffraction measurement into a crystalline part and an amorphous part and performing the base line calibration and the crystallinity is expressed by the percentage of the integral intensity of X-ray of the crystalline part (numerator) to the total integral intensity of X-ray (denominator).

The measurement is carried out by applying the following wide angle X-ray diffraction measuring apparatus and the measuring condition.

X-ray generating apparatus: Rigaku RU-200B

Output: 50 kV, 150 mA

Monochrometer: Graphite

X-ray source: CuKα (0.154184 nm)

Scanning range: $3° \leqq 2\theta \leqq 60°$

Scanning method: θ-2θ

Scanning rate: 2°/min

The constitution material of the fluororesin fine particle is a homopolymer or a copolymer of a fluorine-containing polymerizable monomer, or a copolymer of a fluorine-containing polymerizable monomer and a fluorine free polymerizable monomer. The fluorine-containing polymerizable monomer is represented by the following formula.

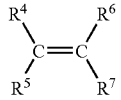

In the formula, at least one of $R^4$ through $R^7$ is a fluorine atom, and the other groups are each independently a hydrogen atom, a chlorine atom, a methyl group, a monofluoromethyl group, a difluoromethyl group or a trifluoromethyl group.

Examples of referable fluorine-containing polymerizable monomer include tetrafluoroethylene, trifluoroethylene, trifluorochloroethylene, hexafluoropropylene, vinyl fluoride, vinylidene fluoride and difluorodichloroethylene.

Examples of the fluorine free polymerizable monomer include vinyl chloride. Two or more kinds of the fluorine free polymerizable monomer may be employed.

The fluororesin fine particle is preferably composed of the homopolymer or copolymer of the fluorine-containing polymerizable monomers, and polytetrafluoroethylene (PTEF), polytrifluoroethylene, tetrafluoroethylene-hexafluoropropylene copolymer and poly(vinylidene fluoride), particularly polyterafluoroethylen, are more preferable.

Though the average molecular weight of the polymer constituting the fluororesin fine particle is not specifically limited as long as the object of the invention can be attained, it is usually suitable from 10,000 to 1,000,000.

The crystallinity of the fluororesin fine particle according to the invention can be varied by a thermal treatment even though it is varied depending on the constituting material. For example, the crystallinity of PTFE fine particles (poly(ethylene terephthalate fine particles) having an average diameter of primary particles of 0.12 μm and a crystallinity of 91.3 can be lowered to 82.8 by thermal treatment for 65 minutes at 250° C. The means for the thermal treatment is not specifically limited and a drying apparatus or a heating furnace can be applied.

The binder of the surface layer preferably contains siloxane-modified polycarbonate. It is preferable that a resin having a surface active group aiding the dispersing of the fluororesin fine particles in a part of the resin structure is employed as a binder in the surface layer. For example, a polycarbonate and a polyallylate having a siloxane group in the structure thereof are preferred. Particularly, siloxane-modified polycarbonates having the following siloxane groups as a part of the structure thereof.

(PC-1)

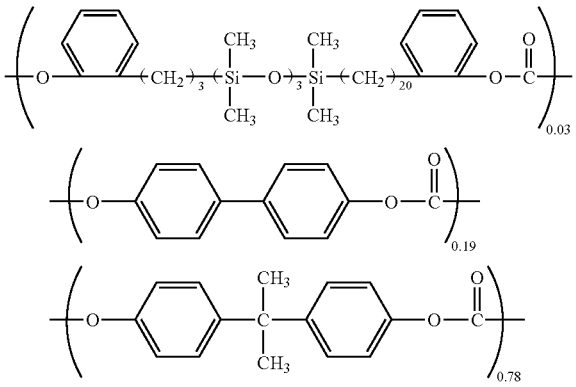

-continued (PC-2)

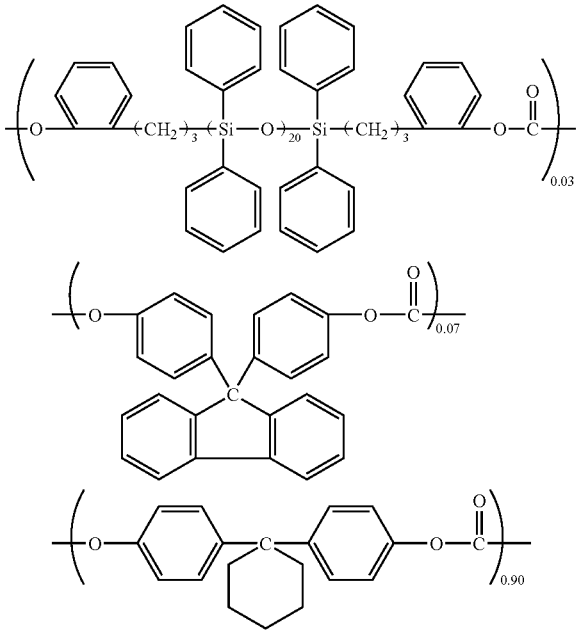

(PC-3)

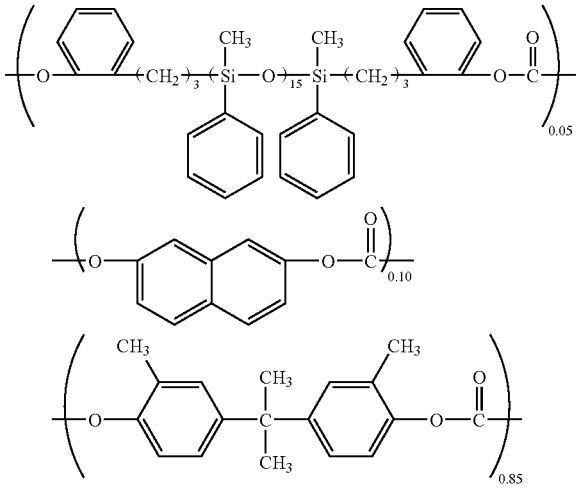

(PC-4)

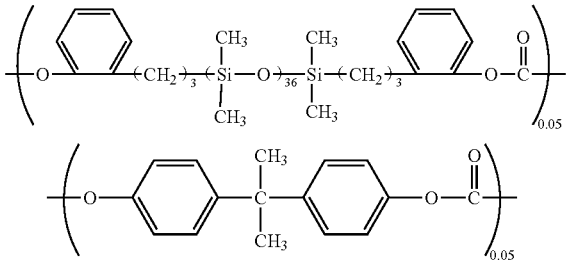

(PC-5)

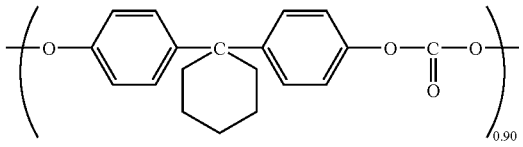

-continued

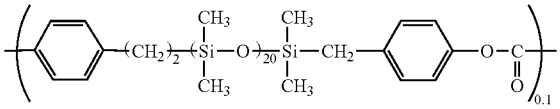

The molecular weight is preferably from 10,000 to 100,000.

For forming the surface layer having the contact angle with water of not less than 90° and the absolute value of a variation of the contact angle within 2.0°, it is preferable to raise the ratio of the fluororesin fine particles in the surface layer. The fluororesin fine particles are preferably employed in a weight ratio of from 20 to 200 parts by weight to 100 parts by weight of the binder resin. By making the ratio as above, the surface layer can be formed which satisfies both of the contact angle of not less than 90° and the absolute value of a variation of the contact angle within 2.0° at the same time, and the surface layer having sufficient strength can be formed and the occurrence of scratches can be prevented.

The fluororesin fine particles are deficient in the uniformly dispersing ability and formation of a uniform and smooth layer with no coagulum is difficult. The fluororesin fine particles having small diameter easily form coagulated particles so as to cause increasing in the scattering of the short wavelength laser light and degrading in the sharpness. However, the surface layer which is formed by improving the dispersing ability of the fluororesin fine particles having an average primary particle diameter of not less than 0.02 μm and less than 0.20 μm so as to have the contact angle of not less than 90° and the absolute value of a variation of the contact angle is within 0.2° can sufficiently prevent the scattering of the short wavelength laser light and occurrence of the dash marks and the black and white lines and can provide the organic photoreceptor capable of forming an electrophotographic image with suitable sharpness.

The surface layer preferably contains an anti-oxidation agent. The anti-oxidation agent is described later.

A dispersion liquid can be prepared by dispersing the fluororesin fine particles having the average primary particle diameter of not less than 0.02 μm and 0.20 μm in a low boiling point organic solvent, preferably one having a boiling point of not more than 120° C., such as THF, ethanol, toluene and dichloroethane for inhibiting the coagulating tendency of the fluororesin fine particles. The coagulation of the fluororesin fine particles can be prevented by coating the dispersion liquid by a coating liquid supplying type coating apparatus and drying the coated layer so that the surface layer can be formed in which the fluororesin particles are sufficiently dispersed. As a result of that, the surface layer having good dispersing status, by which the scatter of the short wavelength laser light can be prevented, and having small contact angle with water and uniform surface energy can be formed so that the occurrence of the dash marks, black and white lines are prevented and the organic photoreceptor capable of forming an electrophotographic image with high sharpness can be produced.

The coating liquid supplying type coating apparatus is a coating apparatus for supplying and coating a coating liquid necessary for forming a layer onto an electroconductive substrate such as a slide hopper type coating apparatus, an extrusion type coating apparatus and a spray coating apparatus. In such the coating liquid supplying type coating apparatus, the coating liquid is not accumulated and the layer is formed by one way flowing of the coating liquid compared with a dipping coating method in which the electroconductive substrate is dipped in the coating liquid. Consequently, the dispersed fluororesin fine particles are not received repeating coagulation shearing force so that the uniform surface almost not containing coagulated particle of the fluororesin fine particles. Moreover, the coagulation by standing of the liquid can be prevented since the coating liquid can be prepared at every time for producing the photoreceptor, and the surface layer can be coated without dissolution of the previously formed lower layer. Therefore, coagulation of the fluororesin fine particle on the occasion of the coating and drying is inhibited so as to for the uniformly dispersed surface layer can be formed.

The method of coating with a coating machine is most preferable to the aforementioned coating apparatus of coating composition supply type, when the dispersion using the aforementioned low-boiling point solvent is employed as a coating composition. In the case of a circular photoreceptor, it is preferred to coat it with the circular slide hopper coating machine described in details in the Japanese Patent O.P.I. 58-189061.

The following gives a brief description of the circular slide hopper coating machine.

Figure 2:
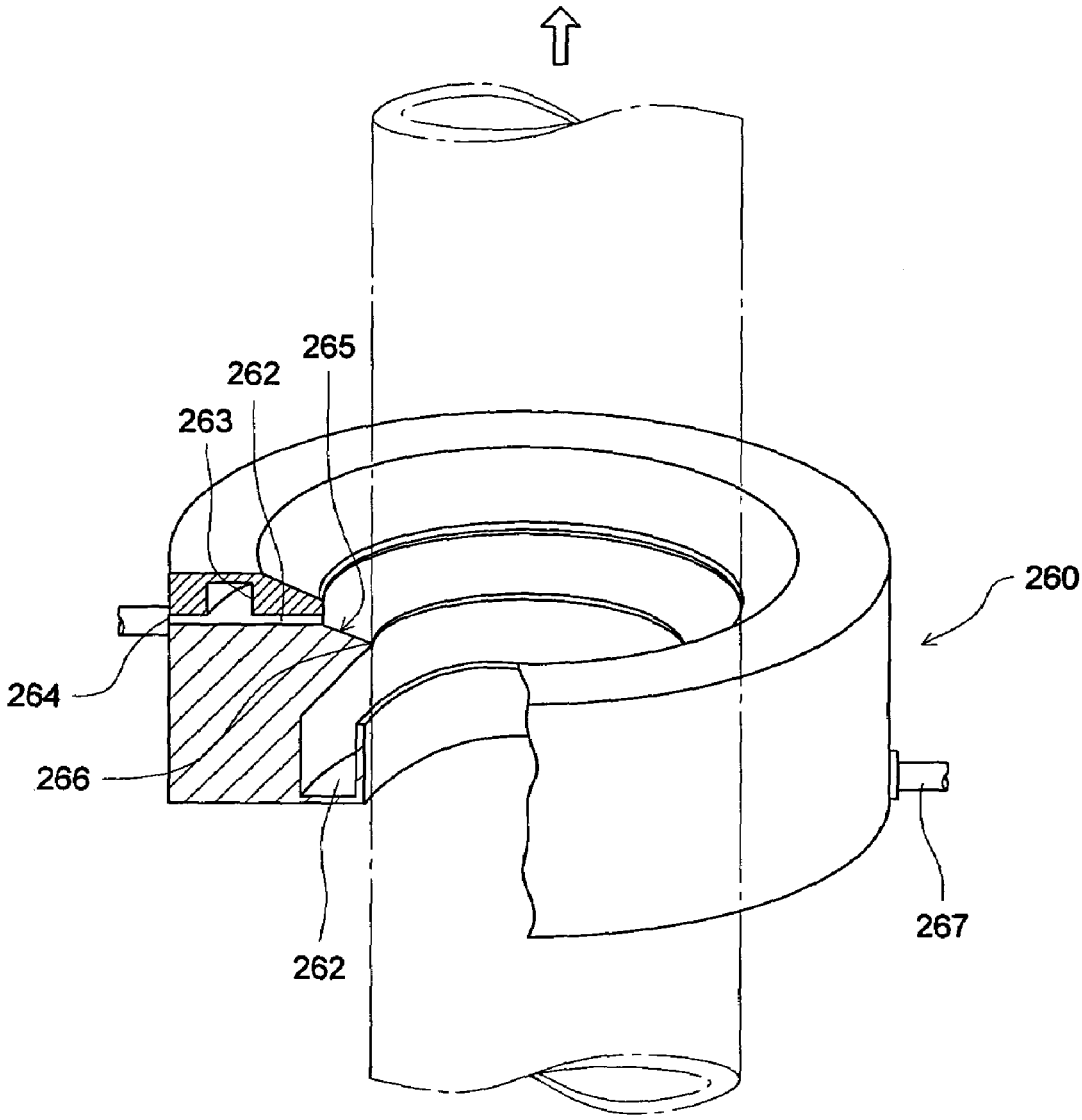
FIG. 2 shows the oblique view of a circular slide hopper type coating apparatus relating to the invention.

The dispersion with fine particles of fluorine-containing resin dispersed therein can be effectively coated using a circular slide hopper coating machine. In an example of the circular slide hopper coating machine, the cylindrical substrates 251A and 251B arranged one on top of the other in the perpendicular direction along the centerline x are raised in the arrow marked direction on a continuous basis, as shown in the cross sectional view of FIG. 1. Coating composition L is coated by the portion 260 (abbreviated as a coating head), enclosing them, directly involved in the coating operation of a slide hopper type coating machine with respect to the outer peripheral surface of the cylindrical substrate 251. A hollow drum, for example, an aluminum drum and plastic drum, or a seamless belt type substrate can be used as the substrate. As shown in FIG. 2, the coating head 260 is provided with a narrow coating composition distribution slit 262 (abbreviated as a slit) having a coating composition outlet 261 opened toward the substrate 251, wherein this coating composition outlet 261 is formed in the horizontal direction. The slit 262 communicates with an annular coating composition distribution chamber 263, and the coating composition L of a storage tank 254 is put into the annular coating composition distribution chamber 263 by the pressure pump 255. In the meantime, a slide surface 265, having a continuous downward inclination, for forming a end portion having the dimension a little greater than the outer dimension of the substrate, is provided on the lower side of the coating composition outlet 261 of the slit 262. Further, a lip-like portion 266 extending downward from the end portion of this slide surface 265 is provided. In the coating operation by such a coating machine, the coating composition L is pushed out of the slit 262 in the process of lifting the substrate 251 and is made to flow downward along the slide surface 265. Then the photosensitive coating composition having reached the end portion of the slide surface forms beads between the end portion of the slide surface and substrate 251, and is then coated on the surface of the substrate. Excess photosensitive coating composition is discharged from the discharge port 267.

In the circular slide hopper coating apparatus, the coating liquid is flowed down along the sliding face 265; the coating liquid arrived at the end edge of the sliding face 265 forms a bead between the end edge of the sliding face 265 and the cylindrical substrate 251A and then a coating layer is formed on the cylindrical substrate.

By the coating method using the circular slide hopper type coating apparatus, the coating can be performed without giving damage to the substrate since the end edge of the sliding face and the substrate are arranged so that a certain space (approximately 2 μm to 2 mm) between them. When plural layers are coated in piles, the previously coated layer is not damaged for the same reason. Furthermore, when plural layers each different in the properties but dissolvable in the same solvent are formed in piles, the coating can be formed without degradation in the dispersed status of the fluororesin fine particles since the composition of the lower layer is dissolved out little into the upper layer and the coating tank since the time for staying the lower layer in the solvent is far shorter compared with the dipping coating method.

The organic photoreceptor is described further.

The organic photoreceptor includes a photoreceptor containing an organic charge generation substance or an charge transportation substance and that containing a polymer complex having the charge generation function and the charge transportation function.

The photoreceptor employed in this invention has a surface layer, which contains fluorinated resin particles and has variation of contact angle against pure water of within ±2.0°.

The organic photoreceptor has such a layer configuration as multi-layer composed of, 1) a photosensitive layer including a charge generation layer and a charge transfer layer on an electro-conductive support in this order,
2) a photosensitive layer including a charge generation layer and a first and a second charge transfer layers on an electroconductive support in this order,
3) a single photosensitive layer having charge generation and charge transfer function on an electro-conductive support in this order,
4) a photosensitive layer including a charge transfer layer and a charge generation layer on an electro-conductive support in this order, or
5) those mentioned above further having a protective layer provided thereon.

The photoreceptor having any configuration can be employed in this invention. The surface layer, which contacts with air, is a photosensitive layer which is provided on an electroconductive substrate singly, or a surface protective layer which is provided on a single or a plurality of photosensitive layer on an electroconductive substrate. The layer configuration 2) mentioned above is employed most preferably. A subbing layer may be provided between the electroconductive layer and the photosensitive layer.

The transfer layer has a function to transfer a charge carrier generated in a charge generation layer via light exposing to a surface of the organic photoreceptor. The function to transfer a charge carrier can be confirmed by detecting photoconductivity by means of a photoreceptor having charge generation layer and a charge transfer layer provided on an electroconductive substrate.

The electrographic photoreceptor is described below concretely with an example having layer arrangement of 2) mentioned above, that is employed most preferably.

Electroconductive Support

A cylindrical electroconductive support is preferably used to make compact the image forming apparatus even though a cylindrical and sheet-shaped support may either be used.

Images can be endlessly formed by the cylindrical electroconductive support. A cylindricity is preferably 5-40 μm, and more preferably 7-30μ.

Cylindricity is based on JIS (B0621-1984). The cylindricity is determined by measuring the roundness at each of the seven positions including a midpoint, two positions spaced a distance of 10 mm from opposite ends, and four intermediate positions determined by dividing a distance between the midpoint and each end into 3 divisions, using a non-contact universal roll diameter measuring device (available from Mitsutoyo Co., Ltd.).

A drum of metal such as aluminum or nickel, a plastic drum on the surface of which aluminum, tin oxide or indium oxide is provided by evaporation, and a plastic and paper drum each coated with an electroconductive substance may be used as the material. The specific electric resistively of the electroconductive support is preferably not more than $10^3$ Ωcm.

The electric conductive support having sealing processed alumite coating at the surface may be employed in the invention. The alumite processing is conducted in acidic bath such as chromic acid, oxalic acid, phosphoric acid, boric acid sulfamic acid etc., and anodic oxidation process in sulfuric acid provides most preferable result. Preferred condition for the anodic oxidation process in sulfuric acid is, for example, sulfuric acid content of 100 to 200 g/l, aluminum ion content of 1 to 10 g/l, bath temperature of around 20° C., and applying voltage of around 20 V. Thickness of the anodic oxidation coating is usually 20 μm or less, particularly 10 μm or less is preferable in average.

Interlayer

In the present invention, an interlayer, functioning as a barrier, may be provided between the electrically conductive support and the photosensitive layer.

An interlayer having a barrier function may be interposed between the electrically conductive substrate and the photosensitive layer. The interlayer (including an undercoat layer) may be also formed for the purpose of improving the adhesion between the electrically conductive substrate and the photosensitive layer or for minimizing charge injection from the substrate. Examples of the material of the interlayer include polyamide resins, vinyl chloride resins, vinyl acetate resins, and copolymer resins comprising at least two repeating units of these resins. Of these subbing resins, polyamide resins are preferable as the resins which are capable of minimizing an increase in residual potential accompanied under repeated use. Further, the thickness of the interlayer comprised of these resins is preferably between 0.01 and 0.5 μm.

The interlayer preferably contains polyamide resin having a heat of fusion of from 0 to 40 J/g and a water absorption degree of not more than 5% by weight.

It is particularly preferred that the interlayer be comprised of a hardenable metal resin obtainable by thermally hardening an organic metal compound such as a silane coupling agent or a titanium coupling agent. The thickness of the interlayer comprised of the hardenable metal resin is preferably between 0.1 and 2 μm.

An intermediate layer containing the N type semi-conductive fine particles dispersed in a binder resin is preferably employed. Average particle diameter is preferably 0.01 to 1 μm. Particularly an inter layer having surface-treated N type semi-conductive fine particles dispersed in a binder resin is preferable. The example is an inter layer in which titanium oxide having particle diameter of 0.01 to 1 μm surface-treated by silica, alumina or silane compound is dispersed in a binder resin. Thickness if the inter layer is preferably 1 to 20 μm.

The N type semi-conductive fine particles used in the invention refer to fine particles having a property in which conductive carrier is an electron. The property in which conductive carrier is an electron is a property that the N type semi-conductive fine particles, when contained in an insulating binder, efficiently block incorporation of holes from a support, and do not block incorporation of electrons from a photoreceptive layer.

The N type semi-conductive fine particles are described.

An inter layer having thickness of 5 mm is formed, by coating a composition containing particles of 50 weight percent dispersed in a binder resin is prepared. The layer is negatively charged and light decay property is evaluated, and further positively charged and light decay property is evaluated.

The fine particles having larger negative charge light decay than positive decay is N type semi-conductive fine particles.

Examples of the N type semi-conductive fine particles include fine particles of metal oxide such as titanium oxide ($TiO_2$), zinc oxide ($ZnO_2$), and tin oxide ($SnO_2$). Titanium oxide and zinc oxide are preferably used, and particularly titanium oxide is preferable.

With respect to the average particle size of the N type semi-conductive fine particles used in the invention, the N type semi-conductive fine particles have a number average primary order particle size of preferably 10 to 500 nm, more preferably 10 to 200 nm, and most preferably 15 to 50 nm.

A coating composition for forming an intermediate layer, containing the N type semi-conductive fine particles having such a number average primary order particle size as described above, has good dispersion stability. Further, the intermediate layer formed from such a coating composition provides a sufficient potential stability and restrains black spot occurrence.

The number average primary order particle size of the N type semi-conductive fine particles described above is obtained by the following. For example, the titanium oxide particles are magnified by a factor of 10,000 according to a transmission electron microscope, and one hundred particles are randomly selected as primary order particles from the magnified particles, and are obtained by measuring an average value of the Fere diameter according to image analysis.

As the N type semi-conductive fine particles used in the invention there are N type semi-conductive fine particles in the dendritic, acicular or granular form. With respect to a crystal structure of such N type semi-conductive fine particles, for example, crystal structures of the titanium oxide include a crystal structure of anatase type, rutile type or amorphous type. Any type crystal structure or a mixture of two or more kinds of crystal structures can be used. The rutile and anatase types are preferred. The most preferable is rutile type.

In the invention, one of the surface treatments of the N type semi-conductive fine particles is that the N type semi-conductive fine particles are subjected to plural surface treatments and the final surface treatment is carried out employing a reactive organic silicon compound. It is preferred that at least one of the plural surface treatments is carried out employing at least one of alumina, silica and zirconia, and the final surface treatment is carried out employing a reactive organic silicon compound. The surface treatment with alumina, silica or zirconia described later refers to surface treatment precipitating alumina, silica or zirconia on the surface of the N type semi-conductive fine particles. The alumina, silica and zirconia precipitated on the surface also include their hydrates. The surface treatment with a reactive organic silicon compound refers to treatment employing the reactive organic silicon compound in a solution for surface treatment.

In the invention, another of the surface treatments of the N type semi-conductive fine particles is that the N type semi-conductive fine particles are subjected to plural surface treatments and the final surface treatment is carried out employing a reactive organic titanium compound or a reactive organic zirconium compound. It is preferred that at least one of the plural surface treatments is carried out employing at least one of alumina, silica and zirconia, and the final surface treatment is carried out employing a reactive organic silicon compound or a reactive organic silicon compound.

Coverage of the surface of the N type semi-conductive fine particles such as the titanium oxide particles subjected to at least two surface treatments is uniform, and an intermediate layer containing the resulting N type semi-conductive fine particles can provide an intermediate layer with good dispersion stability, and a photoreceptor which does not produce image defects such as black spots. Volume ratio of the binder resin to N type semi-conductive fine particles is preferably 1-2 part of the N type semi-conductive fine particles per 1 part of the binder resin.

Photosensitive Layer

Charge Generation Layer

It is preferable to use a charge generation material having high sensitivity at wave length of 350-500 nm in the organic photoreceptor according to this invention. Examples of the charge generation materials include polycyclic quinone pigments, azo pigments, and perylene pigments. These charge generation materials are used either singly or in combination. Preferable charge generation materials are exemplified below.

CGM-1

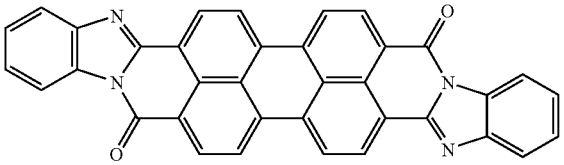

(1)

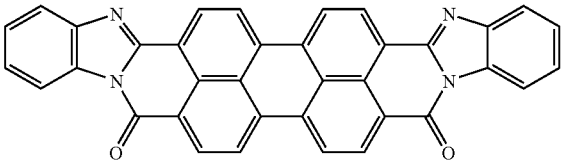

(2)

Mixture of (1) and (2)

-continued

CGM-2

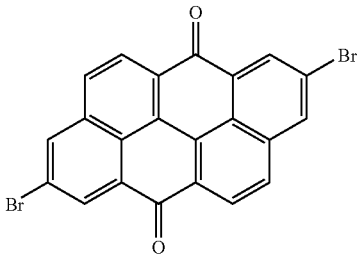

CGM-3

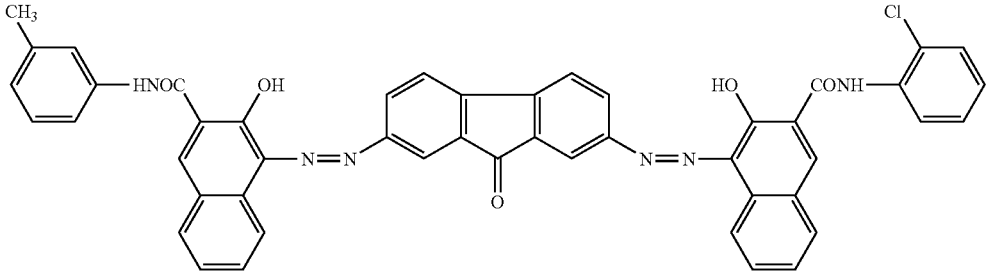

CGM-4

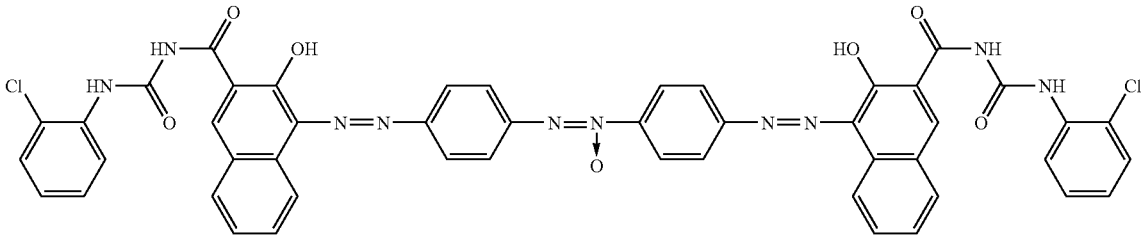

A binder is used in the CGL as the dispersant of the CGM. Preferable examples include formal resin, butyral resin, silicon resin, silicon modified butyral resin and phenoxy resin. CGL in an amount of 20-600 parts by weight is preferably used for 100 parts by weight of binder resin. Increase of residual potential caused by repeating use is minimized by employing such a binder. Thickness of the CGM is preferably 0.3-2 μm.

Charge Transfer Layer

The photoreceptor of this invention preferably composed of a plurality of charge transfer layers, the outermost which comprises fluorinated resin particles.

The charge transfer layer (CTL) comprises a charge transfer material (CTM) and a binder which disperses the CTM and forms a layer. CTL may comprise an anti-oxidation agent further to fluorinated resin particles.

It is possible to employ triphenylamine derivatives, hydrazone compounds, styryl compounds, benzidine compounds, and butadiene compounds as charge transfer materials (CTM). The CGM, which does not absorb laser light for image exposure, is preferably used. These charge transport materials are usually dissolved in appropriate binder resins and are then subjected to layer formation. Preferable examples are listed.

CTM-1

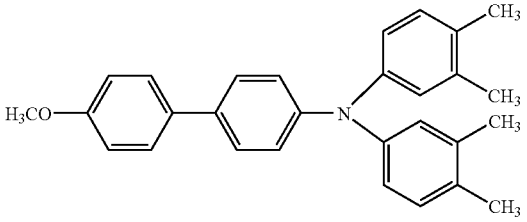

-continued

CTM-2

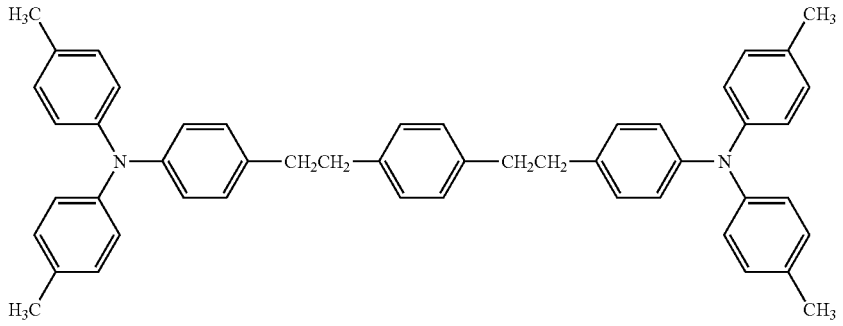

CTM-3

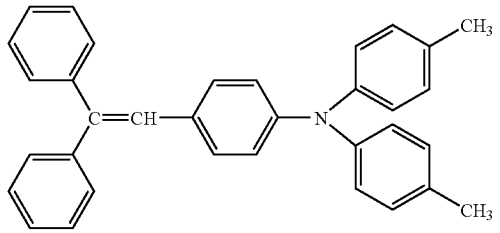

CTM-4

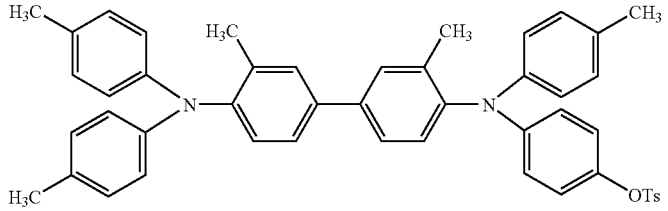

CTM-5

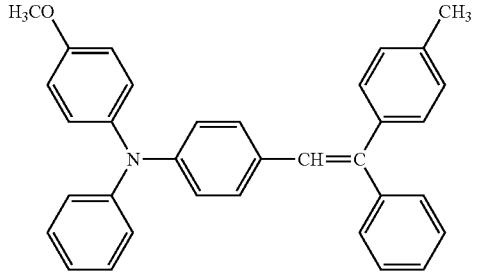

Cited as resins employed in the charge transport layer (CTL) are, for example, polystyrene, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicone resins, melamine resins, and copolymers comprising at least two repeating units of these resins, and other than these insulating resins, high molecular organic semiconductors, such as poly-N-vinylcarbazole. Polycarbonate resin is most preferable among these in view of small water absorbency, good dispersion of CTM and good electrophotographic property.

The ratio of binder resins to charge transport materials is preferably from 50 to 200 weight parts per 100 weight parts of the binder resins. The total thickness of the charge transport layers is preferably 20 μm or less, and preferably from 10 to 16 μm, in view of god sharpness and stable residual potential.

The surface layer containing the fluorinated resin particles preferably contains an anti-oxidation agent, since the layer is susceptible to oxidation caused by active gas generated at the exposing photoreceptor, such as NOx or ozone, whereby image blur occurs. The anti-oxidant inhibits occurrence of the image blur. The anti-oxidant is a substance which inhibits action by oxygen to auto-oxidation material under the circumstances of light, heat and charging.

The preferable examples are listed.
1-1
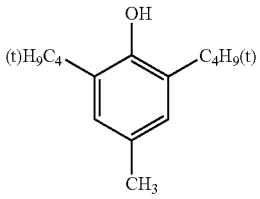
1-2
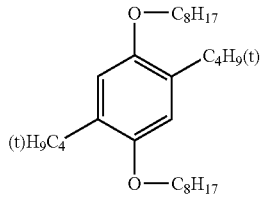
1-3
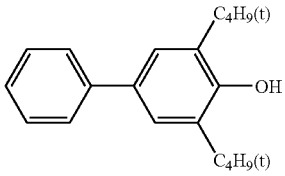
1-4
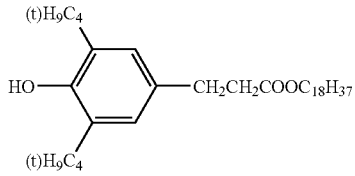
1-5
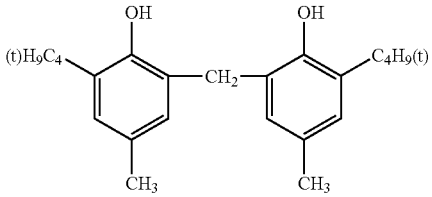
1-6
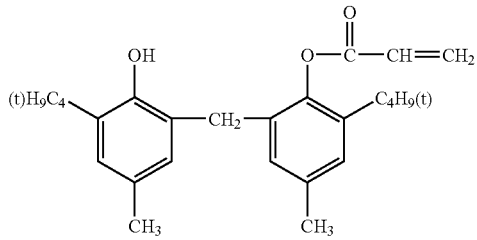
1-7
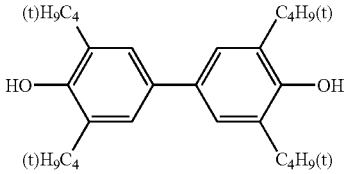
1-8
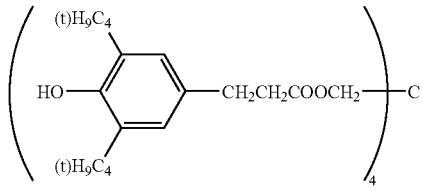
1-9
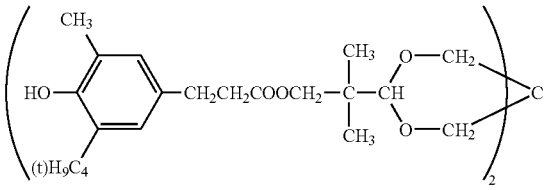
1-10
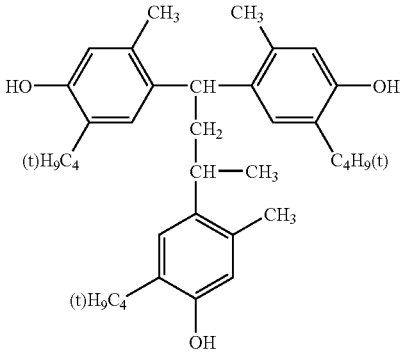

-continued 2-1

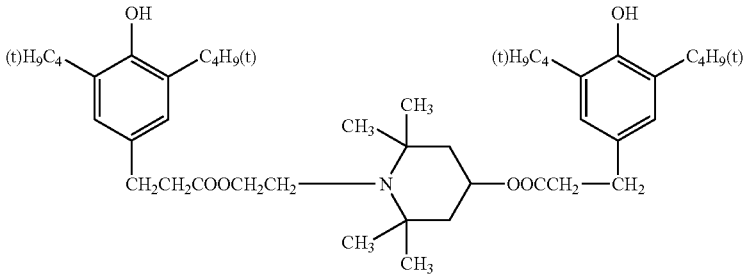

2-2

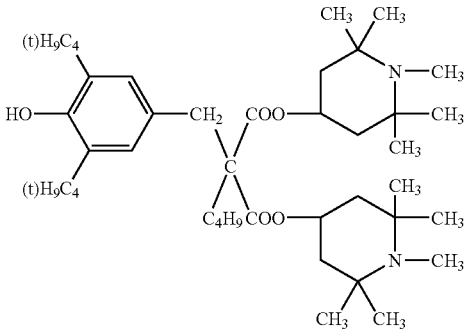

2-3

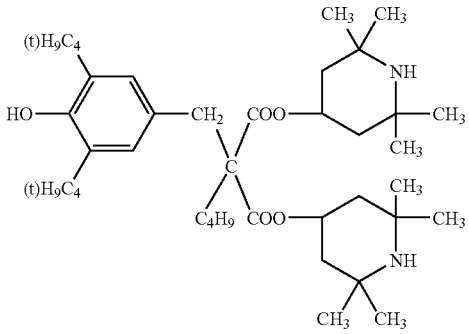

2-4

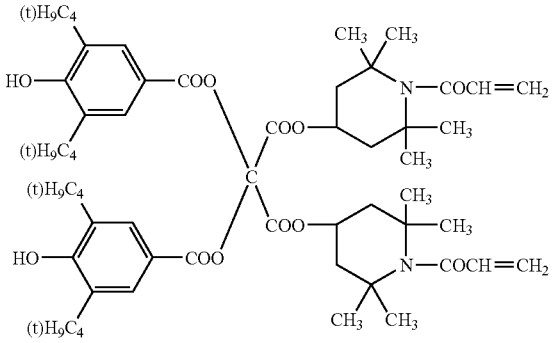

2-5

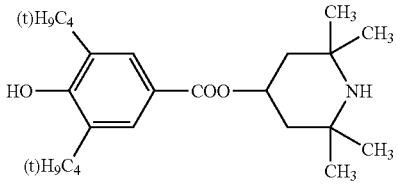

2-6

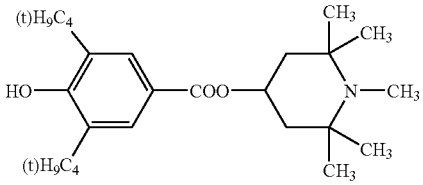

2-7

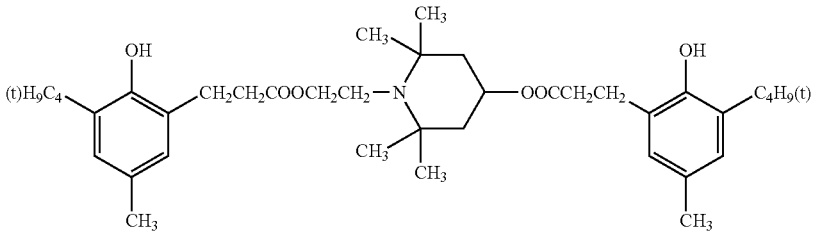

Listed as solvents or dispersion media which are employed to form layers such as interlayers, photosensitive layers, and protective layers, are n-butylamine, diethylamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dicholorethane, 1,2-dichloropropane, 1,1,2-trichloroethane, 1,1,1-trichloroethane, trichloroethylene, tetrachloroethane, tetrahydrofuran, dioxysolan, dioxane, methanol, ethanol, butanol, isopropanol, ethyl acetate, butyl acetate, dimethyl sulfoxide, methyl cellosolve, and the like. However, the present invention is not limited to these examples, and also preferably employed are dichloromethane, 1,2-dicholorethane, methyl ethyl ketone, and the like. Further, these solvents may be employed individually or in combination as a solvent mixture of two or more types.

Latent image formed on the photoreceptor is preferably developed by a toner containing external additives one having particle size of 0.1-1.0 μm and the other having 50 nm or less, whereby marked effect of inhibiting generation of dash mark and retardation of half tone image deterioration can be obtained.

The content of toner particles having a particle diameter below 0.7×(Dp50) is preferably 10 number percents wherein 50% number particle diameter is Dp50.

The ratio (Dv50/Dp50) of toner particles of 50% volume particle diameter (Dv50) and 50% number particle diameter (Dp50) are preferably 1.0-1.15. The ratio (Dv75/Dp75) of a cumulative 75% volume particle diameter (Dv75) from the largest particle diameter on the volume basis and a cumulative 75% number particle diameter (Dp75) from the largest particle diameter on the number basis is preferably 1.0-1.20.

Preferable particle size distribution of toner particles is one which is obtained when particles are monodispersed or nearly monodispersed. It is essential that ratio (Dv50/Dp50) is from 1.00 to 1.15, wherein (Dv50) is the 50 percent volume particle diameter and (Dp50) is the 50 percent number particle diameter. The ratio is more preferably from 1.00 to 1.13.

Further, ratio (Dv75/Dp75) is from 1.00 to 1.12, wherein Dv75 is the cumulative 75 percent volume particle diameter from the maximum diameter of the colored particle and Dp75 is the cumulative 75 percent number particle diameter. An increase in weakly charged components, as well as generation of toner having reverse polarity, is minimized, or generation of excessively charged components is minimized. As a result, it is possible to minimize image degradation due to repellency during transfer, as well as during fixing.

Further, the proportion of colored particles, having a particle diameter of at most 0.7×(Dp50), is less than or equal to 10 percent by number. In the same manner as described above, an increase in weakly charged components, as well as generation of toner having reverse polarity, are minimized, or generation of excessively charged components is minimized. As a result, it is possible to minimize image degradation due to repellency during transfer as well as during fixing.

The 50 percent volume particle diameter (Dv50) is preferably from 3.0 to 9.5 μm, more preferably 3.0 to 7.5 μm. By adjusting said diameter to the above range, it is possible to obtain an enhanced resolution. By adjusting Dv50/Dp50 and Dv75/Dp75 to the specified values as well as by adjusting Dv50 to such a value, it is possible to increase the proportion of toner particles having a minute particle diameter, even though said toner is containing particles having a relatively small diameter, and it is also possible to provide toner capable of forming consistent quality images over an extended period of time.

The cumulative 75 percent volume particle diameter (Dv75) or the cumulative 75 number particle diameter from the largest particle, as described herein, refers to the volume particle diameter or the number particle diameter at the position of the particle size distribution which shows 75 percent of the cumulative frequency with respect to the sum of the volume or the sum of the number from the largest particle.

It is possible to determine 50 percent volume particle diameter (Dv50), 50 percent number particle diameter (Dp50), cumulative 75 percent volume particle diameter (Dv75), and cumulative 75 percent number particle diameter (Dp75), employing a Coulter Counter Type TAII or a Coulter Multisizer (both are manufactured by Coulter Inc.).

The proportion of colored particles having a diameter of less than or equal to 0.7×(Dp50) is 10 percent by number. It is possible to determine the amount of said minute particle toner, employing an Electrophoretic Light Scattering Spectrophotometer ELS-800, manufactured by Otsuka Electronics Co., Ltd.

In the technical field in which electrostatic latent images are visualized employing dry system development, as an electrostatic image developing toner employed are those which are prepared by adding external additives to colored particles containing at least colorants and resins. However, as long as specifically there occur no problems, it is generally described that colored particles are not differentiated from the electrostatic latent image developing toner. The particle diameter and particle size distribution of the colored particles result in the same measurement values as the electrostatic latent image developing toner.

The particle diameter of external agents is in an order of nm in terms of the number average primary particle. It is possible to determine the diameter employing an Electrophoretic Light Scattering Spectrophotometer "ELS-800" (manufactured by Otsuka Electronics Co., Ltd.).

The structure as well as the production method of the toner will now be described.

Toner

Toner which may be prepared by pulverization method or polymerization method can be employed. Polymerization toner is preferably employed because toner having uniform particle size distribution is stably obtained.

The polymerization toner is prepared by polymerization of binder resin of toner from monomers, and if necessary, subsequent chemical process. Practically it includes polymerization process such as suspension polymerization and emulsion polymerization, and fusion process of particles conducted thereafter if necessary.

It is preferable that a coalesced type toner is employed, which is prepared by salting out and fusing resin particles comprising release agents and colorant particles.

As the reason for such toner, it is assumed that since it is possible to easily control the particle size distribution of the coalesced type toner and it is possible to prepare toner particles which exhibit uniform surface properties of each particle, the effects of the present invention are exhibited without degrading transferability.

The "salting-out/fusion", as described above, refers to simultaneous occurrence of salting-out (aggregation of particles) and fusion (disappearance of the boundary surface among particles) or an operation to render salting-out and fusion to occur simultaneously. In order to render salting-out and fusion to occur simultaneously, it is necessary to aggregate particles (resin particles and colorant particles) at temperatures higher than or equal to the glass transition temperature (Tg) of resins constituting the resin particles.

Releasing Agent

The preferable releasing agent is exemplified.

$$R^1—(OCO—R^2)_n$$

In the formula n is an integer from 1 to 4, preferably from 2 to 4, and more preferably 3 or 4.

$R^1$ and $R^2$ each represents a hydrocarbon group, which may have a substituent.

The number of carbon atoms in $R^1$ is from 1 to 40, preferably from 1 to 20, and more preferably from 2 to 5.

The number of carbon atoms in $R^2$ is from 1 to 40, preferably from 16 to 30, and more preferably from 18 to 26.

In the formula (1) n is an integer from 1 to 4, preferably from 2 to 4, more preferably 3 or 4 and particularly 4.

The specific ester compound is synthesized by a dehydration condensation reaction of an alcohol compound and a carbonic acid adequately.

Most preferable example of the ester compound is pentaerythritoltetrabehanate.

Representative examples are listed as compounds 1 to 22.

1) $CH_3-(CH_2)_{12}-COO-(CH_2)_{17}-CH_3$

2) $CH_3-(CH_2)_{18}-COO-(CH_2)_{17}-CH_3$

3) $CH_3-(CH_2)_{20}-COO-(CH_2)_{21}-CH_3$

4) $CH_3-(CH_2)_{14}-COO-(CH_2)_{19}-CH_3$

5) $CH_3-(CH_2)_{20}-COO-(CH_2)_6-O-CO-(CH_2)_{20}-CH_3$

6) $CH_3-(CH_2)_{20}-COO-(CH_2)_2-CH(CH_3)-CH_2-O-CO-(CH_2)_{20}-CH_3$

7) $CH_3-(CH_2)_{22}-COO-(CH_2)_2-CH(CH_3)-CH_2-O-CO-(CH_2)_{22}-CH_3$

8) $CH_3-(CH_2)_{22}-COO-CH_2-C(CH_3)_2-CH_2-O-CO-(CH_2)_{22}-CH_3$

9) $CH_3-(CH_2)_{26}-COO-CH_2-C(CH_3)_2-CH_2-O-CO-(CH_2)_{26}-CH_3$

10)
$$\begin{array}{l} CH_2-O-CO-(CH_2)_{26}-CH_3 \\ | \\ CH-O-CO-(CH_2)_{26}-CH_3 \\ | \\ CH_2-O-CO-(CH_2)_{26}-CH_3 \end{array}$$

11)
$$\begin{array}{l} CH_2-O-CO-(CH_2)_{22}-CH_3 \\ | \\ CH-O-CO-(CH_2)_{22}-CH_3 \\ | \\ CH_2-O-CO-(CH_2)_{22}-CH_3 \end{array}$$

12)
$$\begin{array}{l} CH_2-OH \\ | \\ CH-O-CO-(CH_2)_{26}-CH_3 \\ | \\ CH_2-O-CO-(CH_2)_{26}-CH_3 \end{array}$$

13)
$$\begin{array}{l} CH_2-OH \\ | \\ CH-O-CO-(CH_2)_{22}-CH_3 \\ | \\ CH_2-O-CO-(CH_2)_{22}-CH_3 \end{array}$$

14)
$$\begin{array}{l} CH_2-OH \\ | \\ CH-OH \\ | \\ CH_2-O-CO-(CH_2)_{26}-CH_3 \end{array}$$

15)
$$\begin{array}{l} CH_2-OH \\ | \\ CH-OH \\ | \\ CH_2-O-CO-(CH_2)_{22}-CH_3 \end{array}$$

16) $CH_3-(CH_2)_{26}-COO-CH_2-C(CH_3)(CH_2-O-CO-(CH_2)_{26}-CH_3)-CH_2-O-CO-(CH_2)_{26}-CH_3$

17) $CH_3-(CH_2)_{20}-COO-CH_2-C(CH_2CH_3)(CH_2-O-CO-(CH_2)_{20}-CH_3)-CH_2-O-CO-(CH_2)_{20}-CH_3$

18) $CH_3-(CH_2)_{26}-COO-CH_2-C(CH_2-O-CO-(CH_2)_{26}-CH_3)(CH_2-O-CO-(CH_2)_{26}-CH_3)-CH_2-O-CO-(CH_2)_{26}-CH_3$

19) $CH_3-(CH_2)_{20}-COO-CH_2-C(CH_2-O-CO-(CH_2)_{20}-CH_3)(CH_2-O-CO-(CH_2)_{20}-CH_3)-CH_2-O-CO-(CH_2)_{20}-CH_3$

-continued

20)

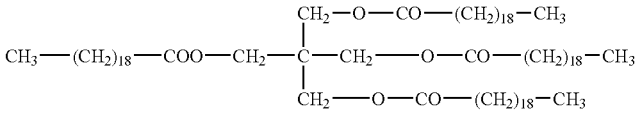

21)

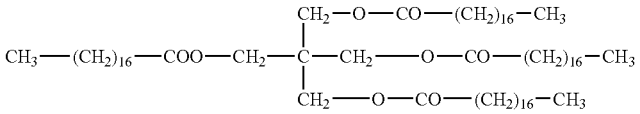

22)

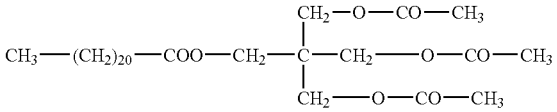

Content of the Releasing Agent

The content ratio of the releasing agent in the toner is commonly from 1 to 30 percent by weight, is preferably from 2 to 22 percent by weight, and is particularly preferably from 1 to 15 percent by weight.

Resin Particles Comprising Releasing Agents

The resin particles containing releasing agents may be obtained as latex particles by dissolving releasing agents in monomers to obtain binding resins, and then dispersing the resulting monomer solution into water based medium, and subsequently polymerizing the resulting dispersion.

The weight average particle diameter of said resin particles is preferably 50 to 2,000 nm.

Listed as polymerization method employed to obtain resin particles, in which binding resins comprise releasing agents, may be granulation polymerization methods such as an emulsion polymerization method, a suspension polymerization method, a seed polymerization method, and the like.

The following method (hereinafter referred to as a "mini-emulsion method") may be cited as a preferable polymerization method to obtain resin particles comprising releasing agents. A monomer solution, which is prepared by dissolving releasing agents in monomers, is dispersed into a water based medium prepared by dissolving surface active agents in water at a concentration of less than the critical micelle concentration so as to form oil droplets in water, while utilizing mechanical force. Subsequently, water-soluble polymerization initiators are added to the resulting dispersion and the resulting mixture undergoes radical polymerization. Further, instead of adding said water-soluble polymerization initiators, or along with said water-soluble polymerization initiators, oil-soluble polymerization initiators may be added to said monomer solution.

Herein, homogenizers which results in oil droplets in water dispersion, utilizing mechanical force, are not particularly limited, and may include "CLEARMIX" (produced by M Tech Co., Ltd.) provided with a high speed rotor, ultrasonic homogenizers, mechanical homogenizers, Manton-Gaulin homogenizers, pressure type homogenizers, and the like. Further, the diameter of dispersed particles is generally 10 to 1,000 nm, and is preferably 30 to 300 nm.

Binder Resins

Binder resins, which constitute the toner of the present invention, preferably comprise high molecular weight components having a peak, or a shoulder, in the region of 100,000 to 1,000,000, as well as low molecular weight components having a peak, or a shoulder, in the region of 1,000 to 20,000 in terms of the molecular weight distribution determined by GPC.

Herein, the method for measuring the molecular weight of resins, employing GPC, is as follows. Added to 1 ml of THF is a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.45 to 0.50 μm, the filtrate is injected in a GPC.

Measurement conditions of GPC are described below. A column is stabilized at 40° C., and THF is flowed at a rate of 1 cc per minute. Then measurement is carried out by injecting approximately 100 μl of said sample at a concentration of 1 mg/ml. It is preferable that commercially available polystyrene gel columns are combined and used. For example, it is possible to cite combinations of Shodex GPC KF-801, 802, 803, 804, 805, 806, and 807, produced by Showa Denko Co., combinations of TSKgel G1000H, G2000H, G3000H, G4000H, G5000H, G6000H, G7000H, TSK guard column, and the like. Further, as a detector, a refractive index detector (IR detector) or a UV detector is preferably employed. When the molecular weight of samples is measured, the molecular weight distribution of said sample is calculated employing a calibration curve which is prepared employing monodispersed polystyrene as standard particles. Approximately ten polystyrenes samples are preferably employed for determining said calibration curve.

The composition materials of resin particles and the preparation thereof will now be described.

Monomers

Of polymerizable monomers which are employed to prepare resin particles, radical polymerizable monomers are essential components, and if desired, crosslinking agents may be employed. Further, at least one of said radical polymerizable monomers having an acidic group or radical polymerizable monomers having a basic group, described below, is preferably incorporated.

(1) Radical Polymerizable Monomers

Radical polymerizable monomers are not particularly limited. It is possible to employ conventional radical polymerizable monomers. Further, they may be employed in combination of two or more types so as to satisfy desired properties.

Specifically, employed may be aromatic vinyl monomers, acrylic acid ester monomers, methacrylic acid ester monomers, vinyl ester monomers, vinyl ether monomers, monoolefin monomers, diolefin monomers, halogenated olefin monomers, and the like.

Listed as aromatic vinyl monomers, for example, are styrene monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrne, 3,4-dichlorostyrene, and the like.

Listed as acrylic acid ester bases monomers and methacrylic acid ester monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, diethyl aminoethyl methacrylate, and the like.

Listed as vinyl ester monomers are vinyl acetate, vinyl propionate, vinyl benzoate, and so on.

Listed as vinyl ether monomers are vinyl methyl ether, vinyl ethyl ether, vinyl isobutyl ether, vinyl phenyl ether, and the like.

Listed as monoolefin monomers are ethylene, propylene, isobutylene, 1-butene, 1-pentene, 4-methyl-1-pentene, and the like.

Listed as diolefin monomers are butadiene, isoprene, chloroprene, and the like.

Listed as halogenated olefin monomers are vinyl chloride, vinylidene chloride, vinyl bromide, and the like.

(2) Crosslinking Agents

In order to improve the desired properties of toner, added as crosslinking agents may be radical polymerizable crosslinking agents. Listed as radical polymerizable agents are those having at least two unsaturated bonds such as divinylbenzene, divinylnaphthalene, divinyl ether, diethylene glycol methacrylate, ethylene glycol dimethacrylate, polyethylene glycol dimethacrylate, phthalic acid diallyl, and the like.

(3) Radical Polymerizable Monomers Having an Acidic Group or a Basic Group

Employed as radical polymerizable monomers having an acidic group or a basic group may, for example, be amine based compounds such as monomers having a carboxyl group, monomers having a sulfonic acid group, and amine based compounds such as primary, secondary, and tertiary amines, quaternary ammonium salts, and the like.

Listed as radical polymerizable monomers having an acidic group are acrylic acid, methacrylic acid, fumaric acid, maleic acid, itaconic acid, cinnamic acid, monobutyl maleate, monooctyl maleate, and the like as monomers having a carboxyl group.

Listed as monomers having sulfonic acid are styrenesulfonic acid, allylsulfosuccinic acid, octyl allylsulfosuccinate, and the like.

These may be in the form of salts of alkali metals such as sodium or potassium, or salts of alkali earth metals such as calcium and the like.

Listed as radical polymerizable monomers having a basic group are amine based compounds which include dimethyl aminoethyl acrylate, dimethyl aminoethyl methacrylate, diethyl aminoethyl acrylate, diethyl aminoethyl methacrylate, and quaternary ammonium salts of said four compounds; 3-dimethylaminophenyl acrylate, 2-hydroxy-3-methacryloxypropyltrimethylammonium salt; acrylamide, N-butylacrylamide, N,N-dibutylacrylamide, piperidylacrylamide, methacrylamide, N-butylmethacrylamide, N-octadecylacrylamide; vinylpyridine; vinylpyrrolidone; vinyl N-methylpyridinium chloride, vinyl N-ethylpyridinium chloride, N,N-diallylmethylammonium chloride, N,N-diallylethylammonium chloride; and the like.

The content ratio of radical polymerizable monomers having an acidic group or a basic group is preferably 0.1 to 15 percent by weight with respect to the total monomers. The content ratio of radical polymerizable crosslinking agents is preferably 0.1 to 10 percent by weight with respect to the total radical polymerizable monomers.

Chain Transfer Agents

For the purpose of regulating the molecular weight of resin particles, it is possible to employ commonly used chain transfer agents.

Said chain transfer agents are not particularly limited, and for example, employed are mercaptans such as octylmercaptan, dodecylmercaptan, tert-dodecylmercaptan, and the like, carbon tetrabromide, styrene dimer, and the like.

Polymerization Initiators

Radical polymerization initiators may be suitably employed in the present invention, as long as they are water-soluble. For example, listed are persulfate salts (potassium persulfate, ammonium persulfate, and the like), azo based compounds (4,4'-azobis-4-cyanovaleric acid and salts thereof, 2,2'-azobis (2-amidinopropane) salts, and the like), peroxides, and the like.

Further, if desired, it is possible to employ said radical polymerization initiators as redox based initiators by combining them with reducing agents. By employing said redox based initiators, it is possible to increase polymerization activity and decrease polymerization temperature so that a decrease in polymerization time is expected.

It is possible to select any polymerization temperature, as long as it is higher than the lowest radical formation temperature of said polymerization initiator. For example, the temperature range of 50 to 90° C. is employed. However, by employing a combination of polymerization initiators such as hydrogen peroxide-reducing agent. (ascorbic acid and the like), which is capable of initiating the polymerization at room temperature, it is possible to carry out polymerization at least room temperature.

Surface Active Agents

In order to perform polymerization employing the aforementioned radical polymerizable monomers, it is required to conduct oil droplet dispersion in a water based medium employing surface active agents. Surface active agents, which are employed for said dispersion, are not particularly limited, and it is possible to cite ionic surface active agents described below as suitable ones.

Listed as ionic surface active agents are sulfonic acid salts (sodium dodecylbenzenesulfonate, sodium aryl alkyl polyethersulfonate, sodium 3,3-disulfondiphenylurea-4,4-diazo-bis-amino-8-naphthol-6-sulfonate, sodium ortho-caroxybenzene-azo-dimethylaniline-2,2,5,5-tetramethyl-triphenylmethane-4,4-diazi-bis-β-naphthol-6-sulfonate, and the like), sulfuric acid ester salts (sodium dodecylsulfonate, sodium tetradecylsulfonate, sodium pentadecylsulfonate, sodium octylsulfonate, and the like), fatty acid salts (sodium oleate, sodium laureate, sodium caprate, sodium caprylate, sodium caproate, potassium stearate, calcium oleate, and the like).

Further, nonionic surface active agents may be employed. Specifically, it is possible to cite polyethylene oxide, polypropylene oxide, a combination of polypropylene oxide and polyethylene oxide, alkylphenol polyethylene oxide, esters of polyethylene glycol with higher fatty acids, esters of polypropylene oxide with higher fatty acids, sorbitan esters, and the like.

Colorants

Listed as colorants which constitute the toner may be inorganic pigments, organic pigments, and dyes.

Employed as said Inorganic pigments may be employed. Specific inorganic pigments are listed below.

Employed as black pigments are, for example, carbon black such as furnace black, channel black, acetylene black, thermal black, lamp black, and the like, and in addition, magnetic powders such as magnetite, ferrite, and the like.

If desired, these inorganic pigments may be employed individually or in combination of a plurality of these. Further, the added amount of said pigments is commonly between 2 and 20 percent by weight with respect to the polymer, and is preferably between 3 and 15 percent by weight.

When employed as a magnetic toner, it is possible to add said magnetite. In that case, from the viewpoint of providing specified magnetic properties, said magnetite is incorporated into said toner preferably in an amount of 20 to 60 percent by weight.

The organic pigments and dyes may be employed. Specific organic pigments as well as dyes are exemplified below.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment yellow 180, C.I. Pigment Yellow 185, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

Employed as dyes may be C.I. Solvent Red 1, 59, 52, 58, 63, 111, 122; C.I. Solvent Yellow 19, 44, 77, 79, 81, 82, 93, 98, 103, 104, 112, 162; C.I. Solvent Blue 25, 36, 60, 70, 93, and 95; and the like. Further these may be employed in combination.

These organic pigments, as well as dyes, may be employed individually or in combination of selected ones, if desired. Further, the added amount of pigments is commonly between 2 and 20 percent by weight, and is preferably between 3 and 15 percent by weight.

The colorants may also be employed while subjected to surface modification. As said surface modifying agents may be those conventionally known in the art, and specifically, preferably employed may be silane coupling agents, titanium coupling agents, aluminum coupling agents, and the like.

External Additives

For the purpose of improving fluidity as well as chargeability, and of enhancing cleaning properties, the toner of the present invention may be employed into which so-called external additives are incorporated. Said external additives are not particularly limited, and various types of fine inorganic particles, fine organic particles, and lubricants may be employed.

Fine inorganic particles may be employed. Specifically, it is possible to preferably employ fine silica, titanium, and alumina particles and the like. These fine inorganic particles are preferably hydrophobic. Specifically listed as fine silica particles, for example, are commercially available R-805, R-976, R-974, R-972, R-812, and R-809, produced by Nippon Aerosil Co.; HVK-2150 and H-200, produced by Hoechst Co.; commercially available TS-720, TS-530, TS-610, H-5, and MS-5, produced by Cabot Corp; and the like.

Listed as fine titanium particles, for example, are commercially available T-805 and T-604, produced by Nippon Aerosil Co.; commercially available MT-100S, MT-100B, MT-500BS, MT-600, MT-600SS, and KA-1, produced by Teika Co.; commercially available TA-300SI, TA-500, TAF-130, TAF-510, and TAF-510T, produced by Fuji Titan Co.; commercially available IT-S, IT-OA, IT-OB, and IT-OC, produced by Idemitsu Kosan Co.; and the like.

Listed as fine alumina particles, for example, are commercially available RFY-C and C-604, produced by Nippon Aerosil Co., commercially available TTO-55, produced by Ishihara Sangyo Co., and the like.

Further, employed as fine organic particles are fine spherical organic particles having a number average primary particle diameter of 10 to 2,000 nm. Employed as such particles may be homopolymers or copolymers of styrene or methyl methacrylate.

Listed as lubricants, for example, are metal salts of higher fatty acids, such as salts of stearic acid with zinc, aluminum, copper, magnesium, calcium, and the like; salts of oleic acid with zinc, manganese, iron, copper, magnesium, and the like; salts of palmitic acid with zinc, copper, magnesium, calcium, and the like; salts of linoleic acid with zinc, calcium, and the like; and salts of ricinolic acid with zinc, calcium, and the like.

The added amount of these external agents is preferably 0.1 to 5 percent by weight with respect to the toner.

The toner of the present invention is a coalesced type toner obtained by salting out/fusing resin particles comprising releasing agents and colorant particles in a water based medium. By salting out/fusing said resin particles comprising releasing agents, as described above, a toner is obtained in which said releasing agents are finely depressed.

In addition, the toner of the present invention possesses an uneven surface from the production stage, and a coalesced type toner is obtained by fusing resin particles and colorant particles. Therefore, differences in the shape as well as surface properties among toner particles are minimal. As a result, the surface properties tend to be uniform. Thus difference in fixability among toner particles tends to be minimized so that it is possible to maintain excellent fixability.

Toner Production Process

One example of the method for producing the toner of the present invention is as follows:

(1) a dissolution process in which releasing agents are dissolved in monomers and a monomer solution is prepared
(2) a dispersion process in which the resulting monomer solution is dispersed into a water based medium
(3) a polymerization process in which the resulting water based dispersion of said monomer solution undergoes polymerization so that dispersion (latex) of resin particles comprising said releasing agents is prepared
(4) a salting-out/fusion process in which the resulting resin particles and said colorant particles are subjected to salting-out/fusion in a water based medium so as to obtain coalesced particles (toner particles)

(5) a filtration and washing process in which the resulting coalesced particles are collected from the water based medium employing filtration, and surface active agents and the like are removed from said coalesced particles (6) a drying process in which washed coalesced particles are dried, and (7) an external addition process may be included in which external agents are added to the dried coalesced particles.

Dissolution Process

Methods for dissolving releasing agents in monomers are not particularly limited.

The dissolved amount of said releasing agents in said monomers is determined as follows: the content ratio of releasing agents is generally 1 to 30 percent by weight with respect of the finished toner, is preferably 2 to 20 percent by weight, and is more preferably 3 to 15 percent by weight.

Further, oil-soluble polymerization initiators as well as other oil-soluble components may be incorporated into said monomer solution.

Dispersion Process

Methods for dispersing said monomer solution into a water based medium are not particularly limited. However, methods are preferred in which dispersion is carried out employing mechanical force. Said monomer solution is preferably subjected to oil droplet dispersion (essentially an embodiment in a mini-emulsion method), employing mechanical force, especially into a water based medium prepared by dissolving a surface active agent at a concentration of lower than its critical micelle concentration.

Herein, homogenizers to conduct oil droplet dispersion, employing mechanical forces, are not particularly limited, and include, for example, "CLEARMIX", ultrasonic homogenizers, mechanical homogenizers, and Manton-Gaulin homogenizers and pressure type homogenizers. Further, the diameter of dispersed particles is 10 to 1,000 nm, and is preferably 30 to 300 nm.

Polymerization Process

In the polymerization process, polymerization methods (granulation polymerization methods such as an emulsion polymerization method, a suspension polymerization method, and a seed polymerization method) may be employed.

Listed as one example of the preferred polymerization method may be a mini-emulsion method, namely in which radical polymerization is carried out by adding water-soluble polymerization initiators to a dispersion obtained by oil droplet dispersing a monomer solution, employing mechanical force, into a water based medium prepared by dissolving a surface active agent at a concentration lower than its critical micelle concentration.

Salting-Out/Fusion Process

In the salting-out/fusion process, a colorant particle dispersion is added to a dispersion containing resin particles obtained by said polymerization process so that said resin particles and said colorant particles are subjected to salting-out/fusion in a water based medium.

Further, in said salting-out/fusion process, resin particles as well as colorant particles may be fused with internal agent particles and the like.

"Water based medium", as described in said salting-out/fusion process, refers to one in which water is a main component (at least 50 percent by weight). Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and the like which do not dissolve resins.

It is possible to prepare colorant particles employed in said salting-out/fusion process by dispersing colorants into a water based medium. Dispersion of colorants is carried out in such a state that the concentration of surface active agents in water is adjusted to at least critical micelle concentration.

Homogenizers to disperse colorants are not particularly limited, and preferably listed are "CLEARMIX", ultrasonic homogenizers, mechanical homogenizers, Manton-Gaulin and pressure type homogenizers, and medium type homogenizers such as sand grinders Getman mill, diamond fine mills and the like. Further, listed as surface active agents may be the same as those previously described.

Further, colorants (particles) may be subjected to surface modification. The surface modification method is as follows. Colorants are dispersed into a solvent, and surface modifiers are added to the resulting dispersion. Subsequently the resulting mixture is heated so as to undergo reaction. After completing said reaction, colorants are collected by filtration and repeatedly washed with the same solvent. Subsequently, the washed colorants are dried to obtain the colorants (pigments) which are treated with said surface modifier.

The salting-out/fusion process is accomplished as follows. Salting-out agents, containing alkaline metal salts and/or alkaline earth metal salts and the like, are added to water comprising resin particles as well as colorant particles as the coagulant at a concentration of higher than critical aggregation concentration. Subsequently, the resulting aggregation is heated above the glass transition point of said resin particles so that fusion is carried out while simultaneously conducting salting-out. During this process, organic solvents, which are infinitely soluble in water, may be added.

Herein, listed as alkali metals and alkali earth metals, employed as salting-out agents, are, as alkali metals, lithium, potassium, sodium, and the like, and as alkali earth metals, magnesium, calcium, strontium, barium, and the like. Further, listed as those forming salts are chlorides, bromides, iodides, carbonates, sulfates, and the like.

Further, listed as said organic solvents, which are infinitely soluble in water, are alcohols such as methanol, ethanol, 1-propanol, 2-propanol, ethylene glycol, glycerin, acetone, and the like. Of these, preferred are methanol, ethanol, 1-propanol, and 2-propanol which are alcohols having not more than 3 carbon atoms.

In the salting-out/fusion process, it is preferable that hold-over time after the addition of salting-out agents is as short as possible. Namely it is preferable that after the addition of salting-out agents, dispersion containing resin particles and colorant particles is heated as soon as possible and heated to a temperature higher than the glass transition point of said resin particles.

The reason for this is not well understood. However, problems occur in which the aggregation state of particles varies depending on the hold-over time after salting out so that the particle diameter distribution becomes unstable and surface properties of fused toner particles fluctuate.

Time before initiating heating (hold-over time) is commonly not more than 30 minutes, and is preferably not more than 10 minutes.

Temperatures, at which salting-out agents are added, are not particularly limited, and are preferably no higher than the glass transition temperature of resin particles.

Further, it is required that in the salting-out/fusion process, the temperature is quickly increased by heating. The rate of temperature increase is preferably no less than 1° C./minute. The maximum rate of temperature increase is not particularly limited. However, from the viewpoint of minimizing the formation of coarse grains due to rapid salting-out/fusion, said rate is preferably not more than 15° C./minute.

Further, after the dispersion containing resin particles and colorant particles is heated to a higher temperature than said glass transition point, it is important to continue the salting-out/fusion by maintaining the temperature of said dispersion for a specified period of time. By so doing, it is possible to effectively proceed with the growth of toner particles (aggregation of resin particles as well as colorant particles) and fusion (disappearance of the interface between particles. As a result, it is possible to enhance the durability of the finally obtained toner.

Further, after terminating the growth of coalesced particles, fusion by heating may be continued.

Filtration and Washing

In said filtration and washing process, carried out is filtration in which toner particles are collected from the toner particle dispersion obtained by the process previously described, and adhered materials such as surface active agents, salting-out agents, and the like, are removed from the collected toner particles (a caked aggregation).

Herein, the filtration methods are not particularly limited, and include a centrifugal separation method, a vacuum filtration method which is carried out employing Buchner's funnel and the like, a filtration method which is carried out employing a filter press, and the like.

Drying Process

The washed toner particles are dried in this process.

Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably employed.

It is proposed that the moisture content of dried toners is preferably not more than 5 percent by weight, and is more preferably not more than 2 percent by weight.

Further, when dried toner particles are aggregated due to weak attractive forces among particles, aggregates may be subjected to pulverization treatment. Herein, employed as pulverization devices may be mechanical pulverization devices such as a jet mill, a Henschel mixer, a coffee mill, a food processor, and the like.

Addition Process of External Additives

This process is one in which external additives are added to dried toner particles.

Listed as devices which are employed for the addition of external additives, may be various types of mixing devices known in the art, such as tubular mixers, Henschel mixers, Nauter mixers, V-type mixers, and the like.

The proportion of number of toner particles having a diameter of at most 0.7×(Dp50) Proportion of is 10 percent or less. It is preferable to control the temperature during the salting-out/fusion narrow for obtaining toner particles satisfying such condition. More in concrete temperature is elevated as fast as possible. The time for elevation is preferably 30 minutes or less, more preferably 10 minutes or less, and the elevation rate is preferably 1 to 15° C./minutes.

Besides colorants and releasing agents, materials, which provide various functions as toner materials may be incorporated into the toner of the present invention. Specifically, charge control agents are cited. Said agents may be added employing various methods such as one in which during the salting-out/fusion stage, said charge control agents are simultaneously added to resin particles as well as colorant particles so as to be incorporated into the toner, another is one in which said charge control agents are added to resin particles, and the like.

In the same manner, it is possible to employ various charge control agents, which can be dispersed in water. Specifically listed are nigrosine based dyes, metal salts of naphthenic acid or higher fatty acids, alkoxyamines, quaternary ammonium salts, azo based metal complexes, salicylic acid metal salts or metal complexes thereof.

Developers

The toner of the present invention may be employed in either a single-component developer or a two-component developer.

Listed as single-component developers are a non-magnetic single-component developer, and a magnetic single-component developer in which magnetic particles having a diameter of 0.1 to 0.5 μm are incorporated into a toner. Said toner may be employed in both developers.

Further, said toner is blended with a carrier and employed as a two-component developer. In this case, employed as magnetic particles of the carrier may be conventional materials known in the art such as metals such as iron, ferrite, magnetite, and the like, alloys of said metals with aluminum, lead and the like. Specifically, ferrite particles are preferred. The volume average particle diameter of said magnetic particles is preferably 15 to 100 μm, and is more preferably 25 to 80 μm.

The volume average particle diameter of said carrier can be generally determined employing a laser diffraction type particle size distribution measurement apparatus "HELOS", produced by Sympatec Co., which is provided with a wet type homogenizer.

The preferred carrier is one in which magnetic particles are further coated with resins, or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute said resin dispersion type carrier, are not particularly limited, and resins known in the art may be employed. For example, listed may be styrene-acryl based resins polyester resins, fluorine based resins, phenol resins, and the like.

It is preferred to employ polymerization toner for developing in this invention. A better image having good sharpness can be obtained by employing the polymerization toner having uniform shape and particle size distribution in combination of the organic photoreceptor containing the fluorinated resin particles in the surface layer.

The polymerization toner is obtained by process which includes forming a binder resin of the toner and chemical treatment thereafter. Practically it is a toner obtained by polymerization reaction such as suspension polymerization and emulsion polymerization and fusion of the particles conducted thereafter.

Preparation by polymerization method is preferable among the method controlling shape coefficient since it is simple and excellent in uniformity of surface in comparison with pulverization toner.

It is possible to prepare the toner of the present invention in such a manner that fine polymerized particles are produced employing a suspension polymerizing method, and emulsion polymerization of monomers in a liquid added with an emulsion of necessary additives is carried out, and thereafter, association is carried out by adding organic solvents, coagulants, and the like. Methods are listed in which during association, preparation is carried out by associating upon mixing dispersions of releasing agents, colorants, and the like which are required for constituting a toner, a method in which emulsion polymerization is carried out upon dispersing toner constituting components such as releasing agents, colorants, and the like in monomers, and the like. Association as described herein means that a plurality of resin particles and colorant particles are fused.

Added to the polymerizable monomers are colorants, and if desired, releasing agent, charge control agents, and further, various types of components such as polymerization initiators, and in addition, various components are dissolved in or dispersed into the polymerizable monomers employing a homogenizer, a sand mill, a sand grinder, an ultrasonic homogenizer, and the like. The polymerizable monomers in which various components have been dissolved or dispersed are dispersed into a water based medium to obtain oil droplets having the desired size of a toner, employing a homomixer, a homogenizer, and the like. Thereafter, the resultant dispersion is conveyed to a reaction apparatus which utilizes stirring blades described below as the stirring mechanism and undergoes polymerization reaction upon heating. After completing the reaction, the dispersion stabilizers are removed, filtered, washed, and subsequently dried. In this manner, the toner is prepared.

A method for preparing said toner may includes one in which resin particles are associated, or fused, in a water based medium. For example, methods described in JP-A Nos. 5-265252, 6-329947, and 9-15904 is listed. It is possible to form the toner of the present invention by employing a method in which at least two of the dispersion particles of components such as resin particles, colorants, and the like, or fine particles, comprised of resins, colorants, and the like, are associated, specifically in such a manner that after dispersing these in water employing emulsifying agents, the resultant dispersion is salted out by adding coagulants having a concentration of at least the critical coagulating concentration, and simultaneously the formed polymer itself is heat-fused at a temperature higher than the glass transition temperature, and then while forming said fused particles, the particle diameter is allowed gradually to grow; when the particle diameter reaches the desired value, particle growth is stopped by adding a relatively large amount of water; the resultant particle surface is smoothed while being further heated and stirred, to control the shape and the resultant particles which incorporate water, is again heated and dried in a fluid state. Further, herein, organic solvents, which are infinitely soluble in water, may be simultaneously added together with said coagulants.

Materials, polymerization methods, reaction apparatuses for the preparation of polymerization toner and so on to prepare a toner having uniform characteristics such as shape coefficient are described in JP A-2000-214629.

An image forming apparatus to which the present invention may be applied is described.

Figure 3:
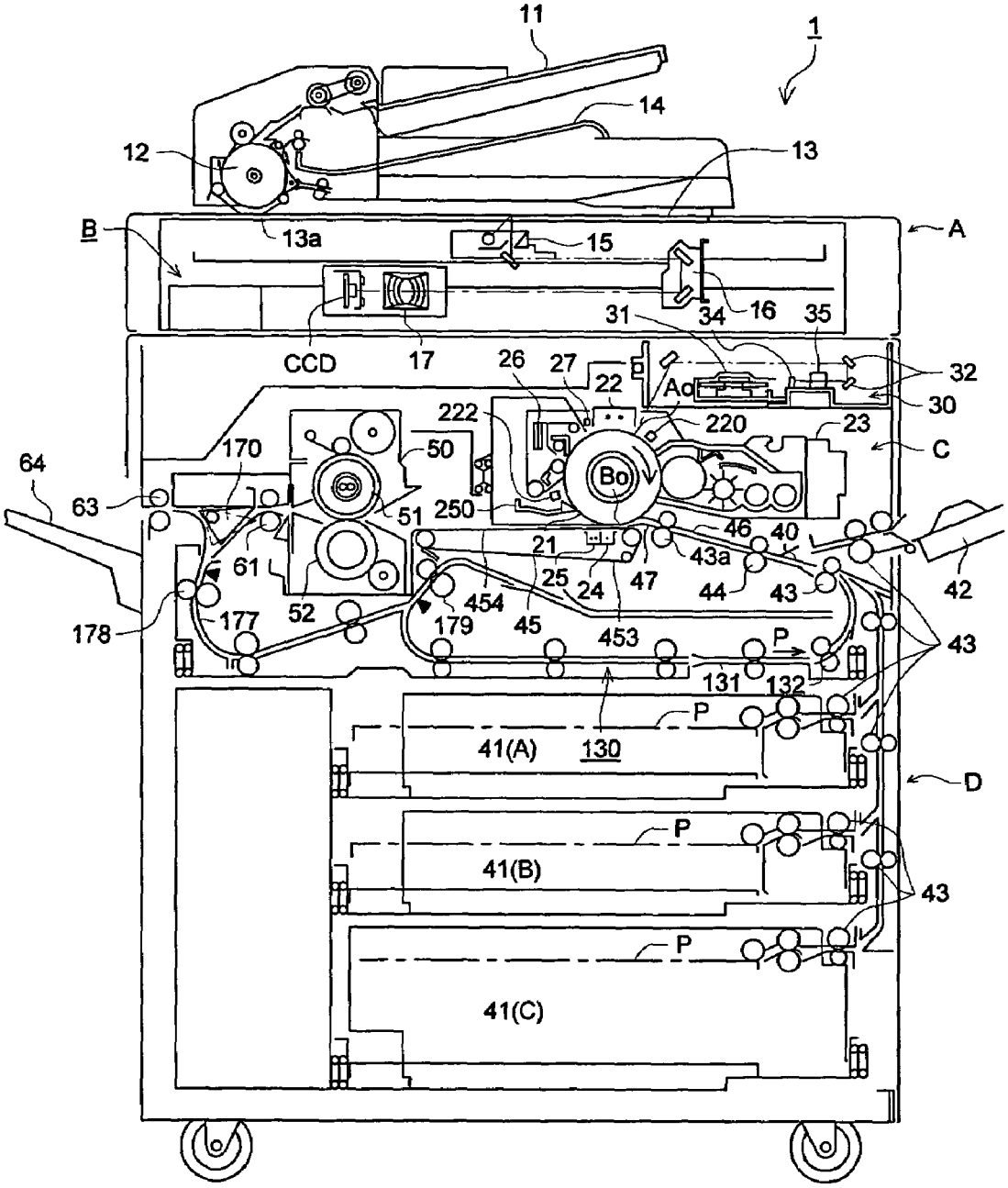
FIG. 3 shows a schematic drawing of a copying apparatus in which the function of the image forming method according to the invention is built.

The image forming apparatus 1 shown in FIG. 3 is a digital type image forming apparatus, and is structured by an image reading section A, image processing section B (not shown), image forming section C, and transfer sheet conveyance section D.

An automatic document feeding means to automatically convey documents is provided on the upper portion of the image reading section A, and the documents placed on a document placement board 11 is separated one by one sheet and conveyed by a document conveyance roller 12, and an image is read at a reading position 13*a*. The document whose reading is completed, is delivered by the document conveyance roller 12 onto a document sheet delivery tray 14.

On the other hand, an image of the document in the case where it is placed on a platen glass 13, is read out by a reading operation at a speed of V of the first mirror unit 15 which is composed of an illumination lamp and the first mirror, and by a moving exposure at a speed of V/2 of the second mirror unit 16 in the same direction which is composed of the second mirror and the third mirror, which are positioned in V letter shape, wherein the first mirror unit 15 and the second mirror unit constitute a scanning optical system.

The read image is formed on the light receiving surface of an image pick-up element CCD, which is a line sensor, through a projection lens 17. A line-like optical image formed on the image pick-up element CCD is successively electro-optical converted into electrical signal (brightness signal), then A/D converted, and after processing such as density conversion, filter processing, or the like, is conducted in an image processing section B, the image data is temporarily stored in a memory.

In the image forming section C, as image forming units, around the outer periphery of a drum-like photoreceptor drum 21 which is an image forming means, a charger 22, which is a charging means, a developing device 23, which is a developing means, a transfer device 24, which is a transfer means, a separation unit 25, which is a separation means, and a cleaning device 26, which is a cleaning means, precharge lamp (PCL) 27 are respectively arranged in the order of operation. A reflective density meter 222, which measures reflective density of developed patch image, is equipped on the photoreceptor at the down stream of the developer 23 The photoreceptor drum 21 is one according to this invention, and is rotated clockwise in the drawing.

After uniform charging by the charger 22 is conducted on the rotating the photoreceptor 21, image exposure is conducted by the exposure optical system 30 according to an image signal read from the memory of the image processing section B. The exposure optical system 30, which is a writing means, uses a laser diode, not shown, as a light emitting source, and an optical path is bent by a reflection mirror 32 through a rotating polygonal mirror 31, fθ lens (no numeric code), and cylindrical lens (no numeric code), and the primary scanning is conducted. The image exposure is conducted at position A on the photoreceptor drum 21, and a latent image is formed by the rotation (the subsidiary scanning) of the photoreceptor drum 21. In the present example, exposure is conducted on a character portion and a reversal latent image is formed.

A semiconductor laser or an emission diode having oscillation wave length of 350-500 nm is employed for image exposure to form a latent image on the photoreceptor in this invention. An electrophotographic image having 600-2400 dpi high definition can be obtained by employing these exposing light source with exposing laser light beam spot of 60 nm or less, preferably 60-15 nm and exposing digitally.

The laser light beam spot is a radius of a circle having the same area corresponding to an area having exposing intensity of more than $1/e^2$ times of peak intensity of the exposing light beam.

Image exposure is conducted by light beam employing a scanning optical system such as semiconductor laser, and a solid scanner such as LED and liquid crystal shutter. The light beam intensity distribution includes Gaussian, Lorentzian and so on, in any which the light beam spot mentioned above may be applied.

The latent image on the photoreceptor drum 21 is reversal-developed by the developing device 23, and a visual image by a toner image is formed on a photosensitive layer surface of the photoreceptor drum 21.

In the transfer sheet conveyance section D, sheet feed units 41 (A), 41(B), and 41(C) in which different sized transfer sheet P are accommodated, are provided in the lower portion of the image forming unit, and on the side portion, a manual sheet feed unit 42 to conduct the manual sheet feed is provided, and the transfer sheet selected from any one of these sheet feed units, is fed along a sheet feed path 40 by a guiding roller 43. The transfer sheet P is temporarily stopped and then fed by the register roller 44 by which inclination and deflection of the feeding transfer sheet are corrected, and through a pre-transfer roller 43*a*, the toner image on the photoreceptor drum 21 is transferred onto the transfer sheet P at the transfer position B by the transfer device 24, next, the transfer sheet P is discharged by the separation unit 25 and separated from the photoreceptor drum 21 surface, and conveyed to the fixing device 50 by the conveyance apparatus 45.

The fixing device 50 has a fixing roller 51 and a pressure roller 52, and the transfer sheet passes between the fixing roller 51 and the pressure roller 52, thereby, toner is fused by heat and pressure. On the transfer sheet P on one side of which the toner image has been fixed, two-sided image formation, by which the toner image is formed also on the other side of the transfer sheet, is conducted according to a mode, which will be described below, or on the condition that the image is formed on only one side of the transfer sheet, the transfer sheet is delivered onto the sheet delivery tray 64.

In the above-mentioned, the situation for image forming on one side of the image receiving sheet is described. When the copies are made on both sides of the sheet, the paper outputting course changing member 170 is switched so that the image receiving paper guiding member 177 is opened and the image receiving paper P is conveyed in the direction of the broken arrow.

The image receiving paper P is conveyed to the lower direction by a conveying mechanism 178 and switch-backed, so as to become the tail of the paper to top, and guided into a paper supplying unit for double-face copying 130.

The image receiving paper P is conveyed to paper supplying direction on the conveying guide 131 provided in the paper supplying unit for double-face copying 130 and re-supplied by the paper supplying roller 132 and guided to the conveying course 40.

The image receiving paper P is conveyed to the photoreceptor 21 as above-mentioned and a toner image is transferred onto the back side of the image receiving paper P, and output onto the paper output tray 64 after fixing the toner image by the fixing means 50.

In the image forming method according to the invention, the photoreceptor and another constituting member such as the developing device and the cleaning device may be combined as a unit of a processing cartridge which can be freely installed to and released from the main body of the apparatus. Besides, at least one of the charging device, imagewise exposing device, developing device, transferring or separating device and cleaning device may be unitized with the photoreceptor to form a processing cartridge which is able to be freely installed to or released from the main body of the apparatus using a guiding means such as a rail.

Figure 4:
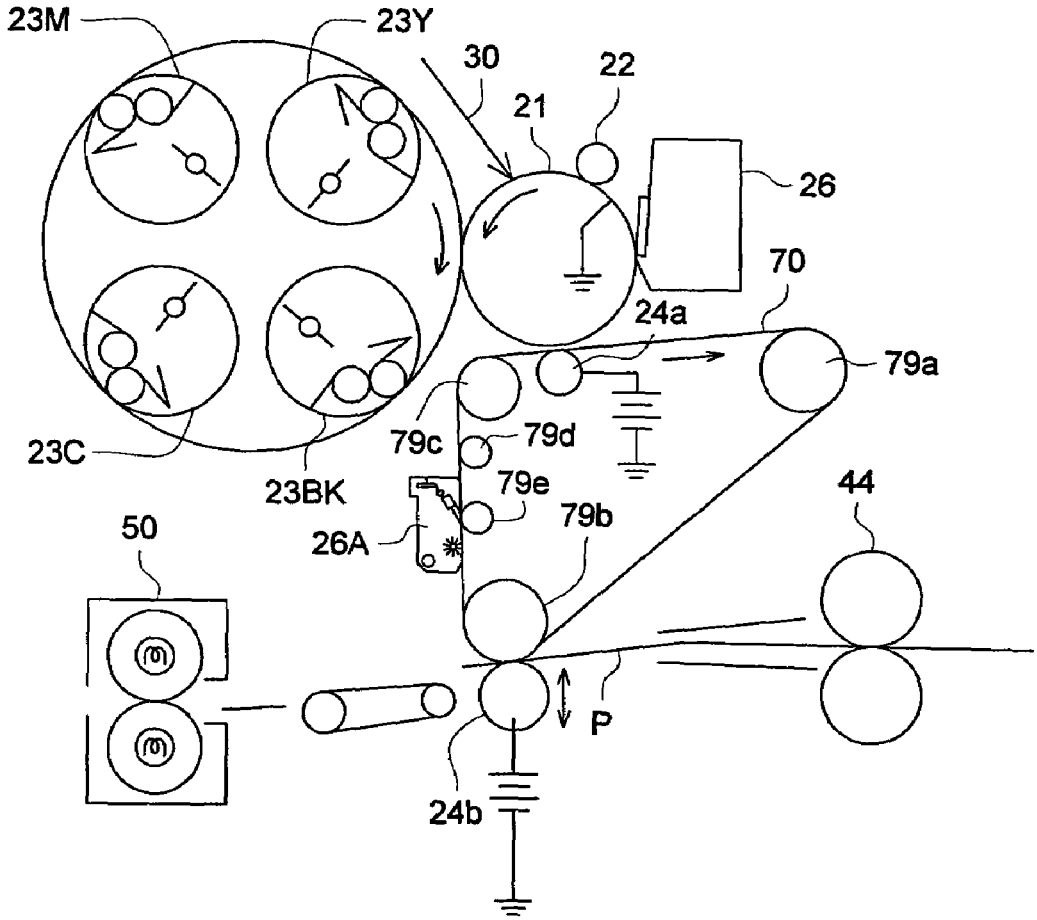
FIG. 4 shows a cross section of another color image forming apparatus.

FIG. 4 shows a cross section of an image forming apparatus to be employed for the image forming method according to the invention (a copy machine or a laser beam printer having at least an organic photoreceptor and around thereof a charging means, an exposing means, a plurality of developing means, a cleaning means and an intermediate transferring member). An elastic material having an intermediate electric resistance is used for the intermediate transferring member 10.

The symbol 21 indicates a rotation drum type photoreceptor repeatedly usable as the image forming member, which is anticlockwise rotated at a designated circumference rate.

In the course of the rotation, the photoreceptor 21 is uniformly charged at a designated polarity and electrical potential by a charging means 22 and then imagewise exposed by scanning by a laser beam modulated by time serial electric digital signals of image information by a imagewise light exposing means 30, not shown in the drawing, so that an electrostatic latent image corresponding to a yellow (Y) color component of an objective color image is formed.

After that, the electrostatic latent image is developed by a yellow color developing means (yellow color developing device) 33Y employing a yellow toner as a first color. On this occasion, actions of second through fourth developing means (a magenta color developing device, cyan color developing device and black color developing device) 23M, 23C and 23Bk are turned off and these developing means do not affect to the photoreceptor 21 so that the yellow toner image as the first color is not influenced by the second through fourth developing devices.

The intermediate transfer member 70 is suspended by rollers 79*a*, 79*b*, 79*c*, 79*d* and 79*e* and driven so as to be clockwise rotated in a circumference rate the same as that of the photoreceptor 21.

The first color of the yellow color image carried on the photoreceptor 21 is successively transferred (the primary transfer) onto the outer surface of the intermediate transfer member 70 by primary transfer bias applied to the intermediate transfer member 70 from the primary transferring roller 24*a*.

After the transfer of the yellow color toner image as the first color, the surface of the photoreceptor 21 was cleaned by a cleaning device 26.

In the similar manner, a magenta toner image as the second color, cyan toner image as the third color and black toner image are successively transferred onto the intermediate transfer member 70 in pile to form the piled color toner image corresponding to the objective color image.

A secondary transfer roller 24*b* is releasably arranges so as to be faced to the lower surface of the intermediate in parallel with a secondary transfer counter roller 79*b*.

The primary bias for successively transferring the toner images of the fist to fourth colors is reversal in the polarity to that of the toner and is applied from a bias power source. The applying voltage of it is, for example, within the range of from +100 V to +2 kV.

In the primary transferring process of the first to third color toner images from the photoreceptor 21 to the intermediate transfer member 70, the secondary transferring roller 24*b* and the intermediate transfer member cleaning means 26A can be released from the intermediate transferring member 70.

In the course of the transfer of the piled color toner image transferred onto the belt-shaped intermediate transfer member 70 to the image receiving material P as a secondary image carrier, the secondary transferring roller 24*b* is contacted to the belt of the intermediate transfer member 70, at the same time the image receiving material P is supplied on designated timing by a pare of paper supplying resist rollers 44 through an image receiving paper guide to the contacting nip of the intermediate transfer member 70 with the secondary transfer roller 24*b*. The secondary bias is applied from a bias power source to the secondary transfer roller 24*b*. The piled color toner image is transferred to the intermediate transfer member 70 to the image receiving material P as the second image carrier (secondary transfer) by the secondary transferring bias. The image receiving material P, on which the toner image is received, is introduced into a fixing means 50 and thermally fixed.

Figure 5:
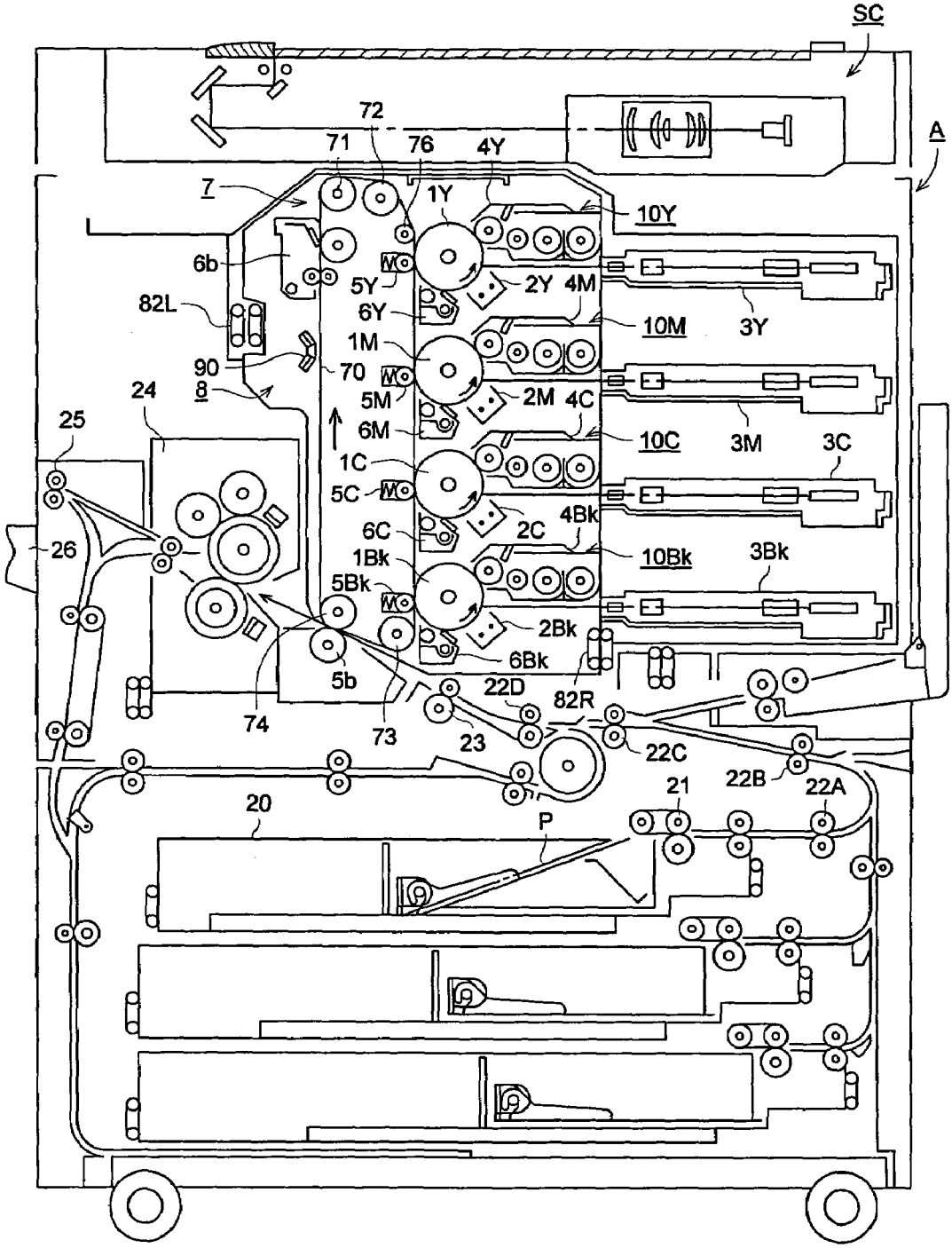
FIG. 5 shows a cross section of the other color image forming apparatus.

FIG. 5 is a cross-sectional construction diagram of another color image forming apparatus, showing an embodiment of the invention.

This color image forming apparatus is called a tandem type color image forming apparatus and is comprised of a set of plurality of image forming sections 10Y, 10M, 10C, and 10K, endless-belt shape intermediate transfer unit 7, sheet convey device 21, and fixing device 24. Document image reading device SC is arranged on body A of the image forming apparatus.

The image forming section 10Y that forms yellow images is comprised of charging device 2Y, exposure device 3Y, developing device 4Y, primary transfer roller 5Y as primary transfer means, and cleaning device 6Y, which are arranged around drum shape photoreceptor 1Y as a first image carrier. The image forming section 10M that forms magenta images is comprised of drum shape photoreceptor 1M as a first image carrier, charging device 2M, exposure device 3M, developing device 4M, primary transfer roller 5M as primary transfer means, and cleaning device 6M. The image forming section 10C that forms cyan images is comprised of drum shape photoreceptor 1C as a first image carrier, charging device 2C, exposure device 3C, developing device 4C, primary transfer roller 5C as primary transfer means, and cleaning device 6C. The image forming section 10K that forms black images is comprised of drum shape photoreceptor 1Bk as a first image carrier, charging device 2Bk, exposure device 3Bk, developing device 4Bk, primary transfer roller 5Bk as primary transfer means, and cleaning device 6 Bk.

Each of the image forming units 10Y, 10M, 10C, and 10K includes photoreceptors 1Y, 1M, 1C, and 1K, charging members 2Y, 2M, 2C, and 2K, exposing members 3Y, 3M, 3C, and 3K, and cleaning members 5Y, 5M, 5C, and 5K.

Each of the image forming units 10Y, 10M, 10C, and 10K has same structures but contains different color toner. Image forming unit 10Y is detailed as an example.

Image forming unit 10Y is composed of a charging member 2Y, an exposing member 3Y, a developing member 5Y provided surrounding photoreceptor 1Y, which is an image forming member to form a toner image. At least photoreceptor 1Y, charging member 2Y, developing member 4Y and cleaning member 5Y are preferably integrated into one body among these members.

The charging member 2Y gives uniform potential to the photoreceptor 1Y, and corona discharger is used in FIG. 5.

Exposing member 3Y gives an exposure corresponding to yellow image signal onto uniformly charged photoreceptor to form a latent image. Example of the exposing member includes laser optics and a combination of LED and CCD (trade name of SELFOC LENS) arranged in line with axis of the photoreceptor. 1Y A semiconductor laser or an emission diode having oscillation wave length of 350-500 nm is employed for image exposure to form a latent image on the photoreceptor in this invention. An electrophotographic image having 600-2400 dpi high definition can be obtained by employing these exposing light source with exposing laser light beam spot of 60 nm or less, preferably 60-15 nm and exposing digitally.

The laser light beam spot is a radius of a circle having the same area corresponding to an area having exposing intensity of more than $1/e^2$ times of peak intensity of the exposing light beam.

Image exposure is conducted by light beam employing a scanning optical system such as semiconductor laser, and a solid scanner such as LED and liquid crystal shutter. The light beam intensity distribution includes Gaussian, Lorentzian and so on, in any which the light beam spot mentioned above may be applied.

The endless belt-shaped intermediate transferring unit 7 has an endless belt-shaped intermediate transferring member 70 as a secondary image carrier which is wound on plural rollers and rotatatably held.

Color images formed in the image forming units 10Y, 10M, 10C and 10Bk, respectively, are successively transferred onto the circulating endless belt-shaped intermediate transferring member 70 by the primary transferring rollers 5Y, 5M, 5C and 5Bk as the primary transferring means, thus a color image is synthesized. Paper P as a recording material (a support carrying the finally fixed image such as a plain paper sheet and a transparent sheet) stocked in a paper supplying cassette 20 is supplied by a paper supplying means 21, and conveyed to a secondary transferring roller 5A as a secondary transferring means through intermediate conveying rollers 22A, 22B, 22C and 22D and a register roller 23. Then the color image is collectively transferred by the secondary transferring onto the paper P. The color image transferred on the paper P is fixed by the fixing means 24 and conveyed by an output roller 25 to be stood on an output tray 26.

Besides, the toner remained on the endless belt intermediate transferring member 70 is removed by the cleaning means 6A after the color image is transferred to the paper P by the secondary transferring roller 5A and the paper P is separated by curvature from the intermediate transferring belt.

In the course of the image formation process, the primary transferring roller 5Bk is constantly pressed to the photoreceptor 1Bk. The other primary transferring rollers 5Y, 5M and 5C are each contacted by pressing to the corresponding photoreceptors 1Y, 1M and 1C, respectively, only for the period of image formation.

The secondary transferring roller 5A is contacted by pressing to the endless belt-shaped intermediate transferring member 70 only for the period of the secondary transferring while passing of the paper P.

A frame 8 can be pulled out from the main body A of the apparatus through supporting rails 82L and 82R.

The box 8 includes the image forming units 10Y, 10M, 10C and 10Bk, and an intermediate transferring unit 7 comprising the endless belt-shaped intermediate transferring member 70.

The image forming units 10Y, 10M, 10C and 10Bk are serially arranged in the perpendicular direction. In the drawing, the endless belt-shaped intermediate transferring unit 7 is arranged at left side of the photoreceptors 1Y, 1M, 1C and 1Bk. The endless belt-shaped intermediate transferring unit 7 included the rotatatable endless belt-shaped intermediate transferring member 70 wound with the rollers 71, 72, 73 and 74, the primary transferring rollers 5Y, 5M, 5C and 5Bk, and the cleaning means 6*b*.

Figure 6:
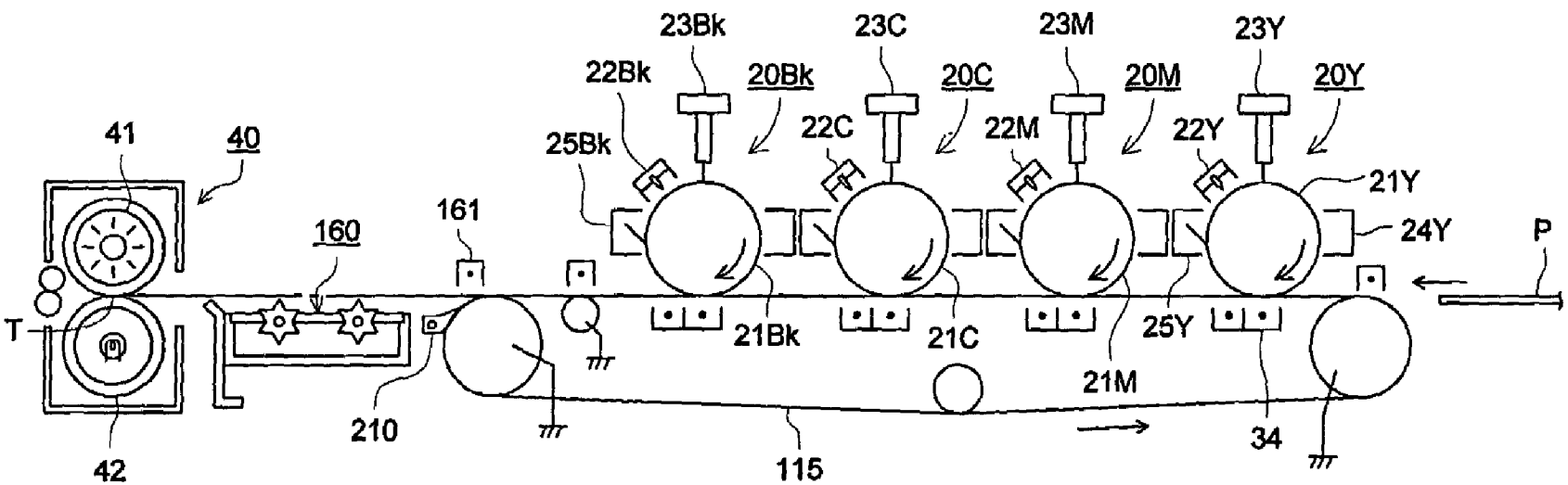
FIG. 6 shows a cross section of still other color image forming apparatus.

FIG. 6 is a cross-sectional construction diagram of the other color image forming apparatus, showing an embodiment of the invention.

This color image forming apparatus is comprised of four set of image forming units 20Y, 20M, 20C, and 20K, along with a conveying member 115 which conveys a recording material.

Each image forming unit, for example, yellow image forming unit 20Y is composed of a photoreceptor drum 21Y, scorotron charging device 22Y, imagewise exposing device 23Y, developing device 24Y, and cleaning device 25Y. Toner images formed on a photoreceptor drums 21Y, 21M, 21C, and 21Bk are transferred on a transfer material (such as paper or transparent sheet) which is synchronously conveyed via transfer device 34Y (and 34M, 34C, and 34Bk) subsequently to superposing each image whereby a color image is formed on the recording material.

The photoreceptor employed in this invention can form an image with high fidelity corresponding to the beam spot area even when the exposure beam is so small. The image is exposed on the photoreceptor preferably by employing light beam having area of not more than 2,000 $\mu m^2$, more preferably 100-1,000 $\mu m^2$. An image of 800 dpi or more having good gradation can be obtained.

The laser light beam spot is a radius of a circle having the same area corresponding to an area having exposing intensity of more than $1/e^2$ times of peak intensity of the exposing light beam.

Image exposure is conducted by light beam employing a scanning optical system such as semiconductor laser, and a solid scanner such as LED and liquid crystal shutter. The light beam intensity distribution includes Gaussian, Lorentzian and so on, in any which the light beam spot mentioned above may be applied.

The recording material is then conveyed by conveying member 115, and separated from it by means of discharge function via AC discharger separator 161 and a separating claw 210 provided on the conveying device 160 with predetermined gap.

The recording material is subjected to fixing toner image by heat and pressure applied at nip T between heating roller 41 and pressure roller 42, in fixing device. The recording material is then carried out.

The conveying member 115 may be belt- or drum-shaped, and prepared by polymer film such as polyimide, polycarbonate, PVdF, or electroconductive synthesized rubber such as silicon rubber and fluorinated rubber having electroconductive filler such as carbon black. Belt shaped conveying member is preferably employed in view of the freedom of design.

The organic photoreceptor according to the invention is commonly suitable for electrophotographic apparatus such as electrophotographic copying machines, laser printers, LED printers and liquid crystal shutter type printers: moreover, the organic photoreceptor is widely applicable for apparatus applying the electrophotographic technology such as display, recording, light pressing work, plate making and facsimile.

EXAMPLES

The present invention is described in detail below referring examples. In the later-mentioned, "part" represents "part by weight".

Preparation of Photoreceptor 1

Photoreceptor 1 was prepared as follows.

An electroconductive substrate having a ten-point surface roughness Rz of 1.5 (μm) was prepared by shaving the surface of a cylindrical aluminum substrate.

<Intermediate Layer>

The following dispersion liquid for the intermediate layer was diluted by 2 times by the same solvent and stood for one night. After that the liquid was filtered by a 5 μm Rigimesh filter, manufactured by Nihon Pall Co. Ltd., to prepare an intermediate layer coating liquid.

| | |
|---|---|
| Polyamide resin CM8000 (Toray Co., Ltd.) | 1 part |
| Inorganic particle: Titanium oxide (Number average primary particles: 35 nm, treated by silica.alumina and methylhydrogennpolysiloxane) | 3 parts |
| Methanol | 10 Parts |

The above-mentioned were dispersed for 10 hours by batch system using a sand mill to prepare the intermediate layer coating liquid.

The intermediate layer coating liquid was coated on the substrate so as to form a layer having a dry thickness of 0.1 μm.

| <Charge generation layer: CGL> | |
|---|---|
| Charge generation material (CGM) (Foregoing CGM-1) | 24 parts |
| Polyvinylbutyral resin S-Lec BL-1 (Sekisui Chemical Co., Ltd.) | 12 parts |
| 2-butanone/cyclohexanone = 4/1 (v/v) | 300 parts |

The above composition was mixed and dispersed by a sand mill to prepare a charge generation layer coating liquid. The coating liquid was coated by a dipping coating method to form a charge generation layer having a dry thickness of 0.5 μm on the intermediate layer.

| <Charge transfer layer 1 (CTL 1)> | |
|---|---|
| Charge transfer material (Forgoing CTM-4) | 225 parts |
| Polycarbonate Z300 (Mitsubishi Gas Chemical Co., Ltd.) | 300 parts |
| Anti-oxidant IRGANOX 1010 (Nihon Ciba-Geigy Co., Ltd.) | 6 parts |
| Dichloromethane | 2000 parts |
| Silicone oil KF-54 (Shin-Etsu Chemical Co., Ltd.) | 1 part |

The above composition was mixed and dissolved to prepare charge transfer layer coating liquid 1. The coating liquid was coated on the foregoing charge generation layer by the dipping coating method and dried at 110° C. for 70 minutes so as to form Charge Transfer Layer 1 having a dry thickness of 10.0 μm.

<Preparation of Polytetrafluoroethylene Resin Particle (PTFE Particle) Dispersion Liquid>

PTFE particles having an average primary particle diameter of 0.12 μm and a crystallinity of 91.3 was thermally treated at 250° C. for 40 minutes for making the crystallinity to 82.8, and a PTFE particle dispersion liquid was prepared using the PTFE particles as follows.

| | |
|---|---|
| PTFE particle PT1 (average primary particle diameter: 0.12 μm, crystallinity: 82.2) | 200 parts |
| Toluene | 600 parts |
| Fluorine-containing comb type graft polymer GF300 (TOAGOSEI Co., Ltd.) | 15 parts |

The above composition was mixed and dispersed by a sand grinder, manufactured by Amex Co., Ltd, to prepare a PTFE particle dispersion liquid.

| <Charge Transfer Layer 2 (CTL 2)> | |
|---|---|
| PTFE particle dispersion liquid | 815 parts |
| Charge transfer material: Forgoing CTM-4 | 150 parts |
| Siloxane-modified polycarbonate resin PC-1 | 150 parts |
| Polycarbonate Z300 (Mitsubishi Gas Chemical Co., Ltd.) | 150 parts |
| Anti-oxidant (Exemplified Compound 2-1) | 12 parts |
| THF: tetrahydrofuran | 2800 parts |
| Silicone oil KF-54 (Shin-Etsu Chemical Co., Ltd. | 4 parts |

The above composition was mixed and dissolved to prepare Charge Transfer Layer Coating Liquid 2. The coating liquid was coated on the foregoing Charge Transfer Layer 1 by the circular slide hopper type coating apparatus and dried at 110° C. for 70 minutes to for Charge Transfer Layer 2 having a dried thickness of 2.0 μm. Thus Photoreceptor 1 was prepared.

Preparation of Photoreceptor 2 through 12

Photoreceptors 2 through 12 were prepared in the same manner as in Photoreceptor 1 except that the thickness of Charge Transfer Layer 1 and the kind and the adding amount of the fluororesin fine particle in Charge Transfer Layer 2 were changed as shown in Table 1-1.

TABLE 1-1

| | | | | Fluororesin particle in CTL 2 | | | | | variation |
|---|---|---|---|---|---|---|---|---|---|
| Photoreceptor No. | CGM in CGL | CTM in CTL 1 and CTL 2 | Thickness of CTL 1 (μm) | Kind | Particle size (μm) (**) | Crystallinity (%) | Adding amount (parts) | Contact angle (°) | of contact angle (\|°\|) |
| 1 | CGM-1 | CTM-4 | 10 | PTFE-1 | 0.12 | 82.2 | 200 | 112 | 1.4 |
| 2 | CGM-1 | CTM-4 | 10 | PTFE-2 | 0.03 | 73.4 | 200 | 115 | 0.8 |
| 3 | CGM-1 | CTM-4 | 10 | PTFE-3 | 0.19 | 86.2 | 200 | 108 | 1.8 |
| 4 | CGM-1 | CTM-4 | 10 | PTFE-4 | 0.01 | 74.6 | 200 | 95 | 2.2 |
| 5 | CGM-1 | CTM-4 | 10 | PTFE-5 | 0.22 | 86.4 | 200 | 98 | 2.3 |
| 6 | CGM-1 | CTM-4 | 14 | PTFE-6 | 0.12 | 89.1 | 200 | 107 | 1.6 |
| 7 | CGM-1 | CTM-4 | 8 | PTFE-1 | 0.12 | 82.2 | 200 | 112 | 1.4 |
| 8 | CGM-1 | CTM-4 | 10 | PTFE-1 | 0.12 | 82.2 | 100 | 92 | 1.9 |
| 9 | CGM-1 | CTM-4 | 10 | PTFE-1 | 0.12 | 82.2 | 50 | 88 | 2.4 |
| 10 | CGM-1 | CTM-4 | 10 | PTFE-1 | 0.12 | 82.2 | 300 | 118 | 1.2 |
| 11 | CGM-1 | CTM-4 | 10 | PTFE-1 | 0.12 | 82.2 | 400 | 128 | 1.0 |
| 12 | CGM-1 | CTM-4 | 10 | H | 0.12 | 45 | 200 | 108 | 1.8 |

(**) Number average diameter of primary particles

In Table 1, PTFE and H represent the following fluororesin fine particle.

PTFE: Poly tetrafluoroethylene resin particle

H: Trifluoroethylene terephthalate resin particle

The contact angle and the variation of contact angle are measured by the foregoing method and the variation of contact angle is represented by absolute value.

<<Evaluation>>

The above obtained photoreceptors were each installed in a color printer available on the market MAGICOLOR 2200 Desk Laser, manufactured by Minolta QMS Co., Ltd., and the following shortwave length laser was used as the light source for imagewise exposing, and the evaluations on the sharpness and the durability were carried out. Images of characters and halftone pictures were printed for 20,000 sheets in total and the evaluations were performed on the initial print and every 5,000th sheets. The items and norms of the evaluation are shown below.

The processing conditions in the above color printer were as follows.

Charging device: Saw-shaped electrode

Exposing device: Semiconductor laser (emitting wave length: 405 nm)

Development: Reversal development by a non-magnetic toner (polymerized toner) having an average particle diameter of 4.5 μm containing strontium titanate of 0.3 μm and hydrophobic silica of 15 nm as external additives.

Transfer: Intermediate transferring belt

Cleaning: Cleaning blade

Fixing: Thermal fixing

Processing speed: 100 mm/sec.

Sharpness

At the initial time of the evaluation, halftone images each having a dot density of 600 dpi (spot diameter of 50 nm), 1,200 dpi (spot diameter of 30 nm) and 2,400 dpi (spot diameter of 15 nm) were printed by varying the spot diameter of the laser beam and evaluated.

Rank A: The halftone images of 600 dpi through 2,400 dpi were each clearly reproduced (the individual dots were independent from each other): Image quality was extremely high.

Rank B: halftone images of 600 dpi through 2,400 dpi were each clearly reproduced but the clarity of halftone image (independency of the dots) of 2,400 dpi was insufficient: The image quality was good.

Rank C: The halftone image of 600 dpi was clearly reproduced but the clarity of the images of 1,200 dpi and 2,400 dpi was insufficient: The image quality was normal.

Rank D: The clarity of the halftone image is insufficient even in the image of 600 dpi: The image quality was insufficient.

(Unevenness in the Image)

A: Any line-shaped-unevenness of image corresponding to the damage on the photoreceptor surface was not observed at all through the 20,000 sheets of print.

B: Any line-shaped unevenness was not observed in the halftone images through the 20,000 sheets of print even though line-shaped unevenness was slightly observed on the photoreceptor surface.

C: Line shaped unevenness in the halftone images corresponding to damages on the photoreceptor surface was clearly observed in the 20,000 sheets of print.

(Blur of Image)

A: Any blurring of image was not observed through the 5,000 sheets of print: Good B: Partial blurring of image was observed on several (less than ten) sheets in the 5,000 sheets of print: No problem for the practical use.

C: Partial blurring of image was observed on ten or more sheets or wide blurring of image was observed on one or more sheets in the 5,000 sheets of print: Problems were posed for the practical use.

(Dash Mark)

The occurrence of the dash mark (comet-shaped small line image) in the halftone image was judged according to the following norms.

A: No nucleus of dash mark was observed on the photoreceptor and the occurrence of dash mark was also not observed in the halftone image: Good B: The occurrence of dash mark was also not observed in the halftone image even though the nucleus of dash mark was observed on the photoreceptor: No problem for the practical use C: The occurrence of the dash mark forming nuclei was observed on the photoreceptor and dash marks occur in the halftone image: Problems were posed for the practical use.

TABLE 1-2

| Photoreceptor No. | Unevenness of image | Blur of image | Dash mark | Sharpness |
|---|---|---|---|---|
| 1 | A | A | A | B |
| 2 | A | A | B | A |
| 3 | A | A | B | C |
| 4 | B | A | C | D |
| 5 | B | A | C | D |
| 6 | A | A | A | B |
| 7 | A | A | A | A |
| 8 | A | A | B | C |
| 9 | C | A | C | D |

TABLE 1-2-continued

| Photoreceptor No. | Unevenness of image | Blur of image | Dash mark | Sharpness |
|---|---|---|---|---|
| 10 | A | A | A | A |
| 11 | B | B | A | A |
| 12 | B | A | B | B |

Table 1-2 demonstrates that Photoreceptors 1 to 3, 6 to 8 and 10 to 12, which contain the fluororesin particles having the average primary particle diameter of not less than 0.02 μm and less than 0.20 μm and have the surface layer (Charge Transfer Layer 2) having the contact angle with water of not less than 20° and the absolute value of a variation of the content angle is within 2.0°, are classified into Rank C or higher and improved in the image unevenness, blurring of image, occurrence of dash mark and sharpness. Contrary, in Photoreceptor 4 using PTFE-4 having the average primary particle diameter of 0.01 μm, the dispersing status of the fluororesin fine particles was inferior, the absolute value of a variation of the contact angle was 2.4°, the sharpness was lowered to Rank D and the dash marks occurred. In Photoreceptor 5 using PTFE-5 having the average primary particle diameter of 0.22 μm, the absolute value of a variation contact angle was 2.3°, the sharpness was lowered to Rank D, the dash marks occurred, the scattering of the laser beam was increased and the sharpness was lowered. Photoreceptor 9 in which the amount of PTFE-1 was reduced so as to lower the contact angle to 88, the sharpness was lowered to Rank D and the unevenness of image and the dash marks occurred, and the sharpness was degraded.

<<Evaluation 2>>

The evaluation was performed in the same manner as in Evaluation 1 except that the semiconductor laser of the exposing device was changed to a light emission diode (wavelength of emitting light: 430 nm). The results of the evaluation were almost the same as those of Evaluation 1.

Preparation of Photoreceptors 13 through 16 Photoreceptors 13 through 16 were prepared in the same manner as in Photoreceptor 1 except that the charge generation material CGM-1 was replaced by CGM-2, CGM-3, CGM-4 or CGM-1, and the charge transfer material CTM-4 in Charge Transfer Layers 1 and 2 was replaced by CTM-1, CTM-2, CTM-3 or CTM-5 as listed in Table 3. The contact angle and the variation of contact angle (represented by absolute value) of Photoreceptors 13 through 16 were measured and the results listed in Table 1-3 were obtained.

TABLE 1-3

| | | | | Fluororesin particle in CTL 2 | | | | | Variation |
|---|---|---|---|---|---|---|---|---|---|
| Photoreceptor No. | CGM in CGL | CTM in CTL 1 and CTL 2 | Thickness of CTL 1 (μm) | Kind | Particle size (μm) (**) | Crystallinity (%) | Adding amount (parts) | Contact angle (°) | of contact angle (\|°\|) |
| 13 | CGM-2 | CTM-1 | 10 | PTFE-1 | 0.12 | 82.2 | 200 | 111 | 1.5 |
| 14 | CGM-3 | CTM-2 | 10 | PTFE-1 | 0.12 | 82.2 | 200 | 110 | 1.4 |
| 15 | CGM-4 | CTM-3 | 10 | PTFE-1 | 0.12 | 82.2 | 200 | 112 | 1.2 |
| 16 | CGM-1 | CTM-5 | 10 | PTFE-1 | 0.12 | 82.2 | 200 | 110 | 1 |

(**) Number average diameter of primary particles

<<Evaluation 1-3>>

Photoreceptors 13 through 16 were evaluated in the same manner as in Evaluation 1 except that the wavelength of emitting light was changed to 480 nm. The evaluation results are listed in Table 1-4.

TABLE 1-4

| Photoreceptor No. | Unevenness in image | Blurring of image | Dash mark | Sharpness |
|---|---|---|---|---|
| 13 | A | A | A | B |
| 14 | A | A | A | B |
| 15 | A | A | A | B |
| 16 | A | A | A | A |

Table 1-4 shows that Photoreceptors 13 to 16 are all in ranks B or higher and the unevenness in image, blurring of image, the occurrence of dash mark and the sharpness are improved.

<<Evaluation 2-1>>

The above prepared Photoreceptors 1 through 12 were evaluated by printing 10,000 copies of a color image including solid and halftone images by the use of a digital copy machine having the structure substantially the same as that shown in FIG. 3, which has an intermediate transferring member (the image quality evaluation by the system or a tandem system for forming an color image by forming images each different in the color on plural photoreceptors and transferring on the onto the intermediate transferring member).

Processing Conditions

Line speed of image formation L/S: 180 mm/s

Four drums for photoreceptor 1Y, 1M, 1C and 1Bk of each of Photoreceptors 1 trough 12 and 17 were employed.

Charging condition of photoreceptor (diameter of 40 mm): the potential at the non-image area was adjusted to −750 V for each of the photoreceptor by feed backing the potential detected by a potential detecting sensor and the surface potential of the photoreceptor after fully exposed was made to a potential within the range of from −50 to 0 V.

Exposing device: A semiconductor laser (wavelength of emitting light of 405 nm)

Development: A reversal development for which double-component developers were respectively employed in the developing means 4Y, 4*m*, 4*c* or 4Bk, each containing yellow, magenta, cyan or black polymerized toner each having an average diameter of 4.5 μm and containing hydrophobic titanium oxide having an average diameter of 0.3 μm and an external additive of hydrophobic silica having an average diameter of 15 nm.

Intermediate transferring member: A seamless endless belt-shaped intermediate transferring member 70 was employed, which was a semi-electroconductive resin belt having a volume resistance of $1\times10^8$ Ω·cm and Rz of 0.9 μm.

Primary Transfer Condition

Primary transfer rollers (5Y, 5M, 5C and 5Bk in FIG. 1, each having a diameter of 6.05 mm): Each constituted by a core metal covered with an elastic rubber layer having a surface relative resistance of $1\times10^6$ W to which transferring voltage was applied.

Secondary Transfer Condition

A backup roller and a secondary transfer roller 5*b* were each arranged on different sides of an endless belt-shaped intermediate transfer member 70. The backup roller has a resistance of $1\times10^6$Ω and the secondary transfer roller as the secondary transfer means has a resistance of $1\times10^6$Ω and electric current of about 80 μm was constantly applied thereto.

The fixing was carried out by a thermal fixing method using a fixing roller in which a heater was arranged.

Evaluation Items and Evaluation Norms

Sharpness

Three halftone images each having dot density of 600 dpi (spot diameter: 50 nm), 1,200 dpi (spot diameter: 30 nm) and 2,400 dpi (spot diameter: 15 nm) were printed for evaluating by varying the spot diameter of the laser beam.

Rank A: The halftone images of 600 dpi through 2,400 dpi were each clearly reproduced (the dots were independently reproduced): Image quality was excellent.

Rank B: The halftone images of 600 dpi and 1,200 dpi were each clearly reproduced, but the clarity (independency of the dots) in the halftone image of 2,400 dpi was insufficient: The image quality was good.

Rank C: The halftone image of 600 dpi was clearly reproduced, but the clarity (independency of the dots) in the halftone images of 1,200 dpi and 2,400 dpi was insufficient: The image quality was normal.

Rank D: The clarity (independency of the dots) in the halftone images of 600 dpi was insufficient: The image quality was insufficient.

Image Density

The reflective density of the image was measured by a densitometer RD-918, manufactured by Macbeth Co., Ltd., the density was expressed by a relative value when the reflective density of the paper was set at 0. The image density was lowered accompanied with many times of printing. The measurement was carried out for the solid image of each color printed after 10,000 sheets of printing.

A: The densities of the solid images of Y, M, C and Bk were each not less than 1.2; good.

B: The densities of the solid images of Y, M, C and Bk were each not less than 0.8; no problem for practical use.

C: The density of at least one of the solid images of Y, M, C and Bk was less than 0.8; a problem was caused in the practical use.

Dash Mark

The status of the periodical occurrence of a dash mark (a small comet-like line image) meeting with the cycle of the photoreceptor was judged according to the following norms.

A: Frequency of dash mark of not less than 0.4 mm: Not more than 5/A4 on the entire printed images; good.

B: Frequency of dash mark of not less than 0.4 mm: One or more prints having 6/A4 to 10/A4 of dash marks were observed; no problem for practical use.

C: Frequency of image defects cased by the dash mark of not less than 0.4 mm: One or more print having 11/A4 dash mark were observed; a problem was caused in the practical use.

Unevenness of Image

A: No stripe-shaped unevenness was observed in any halftone images through the 10,000 prints.

B: No stripe-shaped unevenness was observed in any halftone images through the 10,000 prints even though a slight stripe-shaped unevenness was observed on a part of the photoreceptor surface.

C: Strip-shaped unevenness meeting with the damage on the photoreceptor surface was clearly observed on the entire surface of the halftone image during the 10,000 prints.

Color Difference

Continuous printing was run under a condition of 20° C. and 60% RH, and the solid image of the secondary colors (red, green and blue) was measured by Macbeth Color-Eye 7000 on the initial and $10{,}000^{th}$ print and the color difference was calculated by CMC (2:1) color difference expression. The color difference calculated by CMC (2:1) color difference expression was evaluated according to the following norms; the sample having a color difference of not more than 5 was acceptable.

A: The color difference was not more than 3; good.

B: The color difference was within the range of from 3 to 5; no problem for practical use.

C: The color difference was not less than 5; a problem was posed in practical use.

Results are listed in Table 2-1.

TABLE 2-1

| Photoreceptor No. | Sharpness | Image density | Dash mark | Image unevenness | Color difference |
|---|---|---|---|---|---|
| 1 | A | A | B | A | B |
| 2 | A | A | A | A | A |
| 3 | A | A | B | A | B |
| 4 | D | B | C | C | C |
| 5 | D | B | C | C | B |
| 6 | A | A | A | A | C |
| 7 | B | B | B | B | B |
| 8 | A | A | B | A | B |
| 9 | B | C | C | B | C |
| 10 | A | A | A | A | A |
| 11 | A | A | A | A | A |
| 12 | A | A | B | A | B |

Table 2-1 shows that the color images, in which the image density was sufficiently high, the dash mark and the image unevenness were improved, the color difference after 10,00 prints was small and sharpness was high through the initial through 10,000th print, can be obtained when the photoreceptors according to the invention, Photoreceptors 1 to 3, 6-8, or 10 to 12, were employed in the tandem type image forming apparatus using the intermediate transfer member. These photoreceptors of the invention contain the fluororesin fine particles having an average primary particle diameter of not less than 0.02 μm and less than 0.20 μm and a crystallinity of less than 90%, and the binder resin, and have the surface layer (charge transfer layer 2) having a contact angle with water of not less than 90° and the absolute value of a variation of the contact angel of within 2.0°. Contrary to that, in Photoreceptor 4 employing PTFE having an average primary particle diameter of 0.01 μm, the dispersed state of the fluororesin particles in the surface layer was degraded and the absolute value of a variation of contact angle was increased to 2.2°, and in the images formed by this photoreceptor, the dash marks and the image unevenness were formed, the color difference was raised and the sharpness was degraded. In Photoreceptor 5 using PTFE-5 having an average diameter of primary particles of 0.22 μm, the absolute value of a variation of contact angle was increased to 2.3° and in the images formed by this photoreceptor, the dash marks and the image unevenness were caused and the color difference was increased. In Photoreceptor 7 using PTFE-7 having a crystallinity of 91.3, the scatter of contact angle was increased to 2.2, and in the images formed by this photoreceptor, the dash marks and the image unevenness were caused, the color difference was increased and the sharpness was lowered. By Photoreceptor 9 in which the content of PTFE-1 in the surface layer (charge transfer layer 2) was reduced for lowering the contact angle to 88°, the dash marks and the image unevenness were considerably caused, the image density was lowered and the color difference was increased. In Photoreceptor 17 in which the surface layer (charge transfer layer 2) was coated by the immersion coating apparatus, the scatter of the contact angle was increased to 2.6, and in the image formed by this photoreceptor, it was observed that the dash marks were caused, the color difference of the color image was made larger and the sharpness was degraded.

<<Evaluation 2-2>>

The evaluation was carried out by using a digital copying machine having an intermediate transfer member based on the structure shown in FIG. 4 (the evaluation of the quality of image formed by the system in which toner images each different in the color are formed on one photoreceptor and the images are successively transferred on the intermediate transfer member to form a color image).

The photoreceptors were each installed in a color printer available on the market MAGICOLOR 2300 Desk Laser, manufactured by Minolta QMS Co., Ltd., and durability tests were carried out under a low temperature and low humidity condition (LL: 10° C., 20% RH). A picture including character image with a pixel ratio of 7%, a halftone image, a solid white image and a solid black image each occupying a quarter area was printed for 10,000 sheets and the evaluation was performed at the initial time and after 10,000 sheets of print. Evaluation items and the evaluation norms are shown below.

The processing condition of the color printer was as follows.

Charging device: Saw tooth electrode

Exposing device: Semiconductor laser (Emission wavelength: 405 nm)

Development: As the yellow, magenta, cyan and black toners, non-magnetic polymerized toners each of which have an average particle diameter of 4.5 μm and contain strontium titanate of 0.3 m and hydrophobic silica of 15 nm as the external additives were employed for each of the developing means 4Y, 4M, 4C and 4Bk. Development was carried out by a reversal development method.

Transferring: Intermediate transfer belt

Cleaning: Cleaning blade

Fixing: Thermal fixing

Processing speed: 100 mm/sec

The items and the norms of the evaluation were the same as those in <<Evaluation 2-1>>. The evaluation results of Photoreceptors 1 to 12 and 17 were almost the same as the results obtained in <<evaluation 2-1>>.

<<Evaluation 2-3>>

The evaluation was carried out in the same manner as in Evaluation 2-2 except that the semiconductor laser in the exposing device is replaced by a light emission diode emitting light of 430 nm. The evaluation results were almost the same as those of Evaluation 2-2 even though the light emission diode was used for the light source.

<<Evaluation 2-4>>

Photoreceptors 13 to 16 were evaluated in the same manner as in Evaluation 1 except that the emission wavelength of semiconductor laser was changed to 480 nm. The results of the evaluation are listed in Table 2-2.

TABLE 2-2

| Photoreceptor No. | Sharpness | Image density | Dash mark | Image unevenness | Color difference |
|---|---|---|---|---|---|
| 13 | A | A | A | A | A |
| 14 | A | A | A | A | A |
| 15 | A | A | A | A | A |
| 16 | A | A | A | A | A |

Result in Table 2-2 shows that Photoreceptors 13 to 16 were improved in the image density, dash mark, image unevenness and color difference, and the sharpness was also high.

<<Evaluation 3-1>>

Four photoreceptors of each photoreceptor sample prepared above were installed in a tandem type digital printer shown in Table 6 having image forming units of Y (yellow), M (magenta), C (cyan) and Bk (black).

Processing Condition

Line speed of image formation L/S: 180 mm/s

Charging condition of photoreceptor (diameter of 40 mm): the potential at the non-image area was adjusted to −750 V for each of the photoreceptor by feed backing the potential detected by a potential detecting sensor and the surface potential of the photoreceptor after fully exposed was made to a potential within the range of from −50 to 0 V.

Exposing device: Semiconductor laser (Emitting wavelength: 405 nm)

Development: As the yellow, magenta, cyan and black toners, non-magnetic polymerized toners each of which have an average particle diameter of 4.5 μm and contain externally added strontium titanate of 0.3 μm and hydrophobic silica of 15 nm were employed for each of the developing means 4Y, 4M, 4C and 4Bk. Development was carried out by a reversal development method.

Transfer Condition

Transfer belt: A urethane belt in which carbon black was dispersed was employed at an expanding ratio of 3%.

Transfer electrode: Colona discharger

Power source voltage of transferring constant current: +3.5 kV to +7.5 kV

Cleaning Condition of Photoreceptor

Cleaning blade: Urethane rubber blade contacted to the photoreceptor in the counter direction to the rotation direction of the photoreceptor.

The fixing was carried out by a thermal fixing method using a fixing roller in which a heater was arranged.

Evaluation Items and Evaluation Norms

Sharpness (Dot Reproduction)

Three halftone images each having dot density of 600 dpi (spot diameter: 50 nm), 1,200 dpi (spot diameter: 30 nm) and 2,400 dpi (spot diameter: 15 nm) were printed for evaluating by varying the spot diameter of the laser beam.

Rank A: The halftone images of 600 dpi through 2,400 dpi were each clearly reproduced (the dots were independently reproduced): Image quality was excellent.

Rank B: The halftone images of 600 dpi and 1,200 dpi were each clearly reproduced, but the clarity (independency of the dots) in the halftone image of 2,400 dpi was insufficient: The image quality was good.

Rank C: The halftone image of 600 dpi was clearly reproduced, but the clarity (independency of the dots) in the halftone images of 1,200 dpi and 2,400 dpi was insufficient: The image quality was normal.

[31289]

Rank D: The clarity (independency of the dots) in the halftone images of 600 dpi was insufficient: The image quality was insufficient.

Image Density

The reflective density of the image was measured by a densitometer RD-918, manufactured by Macbeth Co., Ltd., the density was expressed by a relative value when the reflective density of the paper was set at 0. The image density was lowered accompanied with many times of printing. The measurement was carried out for the solid image of each color printed after 10,000 sheets of printing.

A: The densities of the solid images of Y, M, C and Bk were each not less than 1.2; good.

B: The densities of the solid images of Y, M, C and Bk were each not less than 0.8; no problem for practical use.

C: The density of at least one of the solid images of Y, M, C and Bk was less than 0.8; a problem was caused in the practical use.

Dash Mark

The status of the periodical occurrence of a dash mark (a small comet-like line image) meeting with the cycle of the photoreceptor was judged according to the following norms.

A: Frequency of dash mark of not less than 0.4 mm: Not more than 5/A4 on the entire printed images; good.

B: Frequency of dash mark of not less than 0.4 mm: One or more prints having 6/A4 to 10/A4 of dash marks were observed; no problem for practical use.

C: Frequency of image defects cased by the dash mark of not less than 0.4 mm: One or more print having 11/A4 dash mark were observed; a problem was caused in the practical use.

Unevenness of Image

A: No stripe-shaped unevenness was observed in any halftone images through the 10,000 prints.

B: No stripe-shaped unevenness was observed in any halftone images through the 10,000 prints even though a slight stripe-shaped unevenness was observed on a part of the photoreceptor surface.

C: Strip-shaped unevenness meeting with the damage on the photoreceptor surface was clearly observed on the entire surface of the halftone image during the 10,000 prints.

Color Difference

Continuous printing was run under a condition of 20° C. and 60% RH, and the solid image of the secondary colors (red, green and blue) was measured by Macbeth Color-Eye 7000 on the initial and 10,000th print and the color difference was calculated by CMC (2:1) color difference expression. The color difference calculated by CMC (2:1) color difference expression was evaluated according to the following norms; the sample having a color difference of not more than 5 was acceptable.

A: The color difference was not more than 3; good.

B: The color difference was within the range of from 3 to 5; no problem for practical use.

C: The color difference was not less than 5; a problem was posed in practical use.

Results are listed in Table 3-1.

TABLE 3-1

| Photoreceptor No. | Sharpness | Image density | Dash mark | Image unevenness | Color difference |
|---|---|---|---|---|---|
| 1 | A | A | B | A | B |
| 2 | A | A | A | A | A |
| 3 | A | A | B | A | B |
| 4 | D | B | C | C | C |
| 5 | D | B | C | C | B |
| 6 | A | A | A | A | C |
| 7 | B | B | B | B | B |
| 8 | A | A | B | A | B |
| 9 | B | C | C | B | C |
| 10 | A | A | A | A | A |
| 11 | A | A | A | A | A |
| 12 | A | A | B | A | B |

Table 3-1 shows that the color images, in which the image density was sufficiently high, the dash mark and the image unevenness were improved, the color difference after 10,000 prints was small and sharpness was high through the initial through 10,000th print, can be obtained when the photoreceptors according to the invention, Photoreceptor 1 to 3, 6-8, or 10 to 12, was employed in the tandem type image forming apparatus using the intermediate transfer member. These photoreceptors of the invention contain the fluororesin fine particles having an average primary particle diameter of not less than 0.02 μm and less than 0.20 μm and a crystallinity of less than 90%, and the binder resin, and have the surface layer (charge transfer layer 2) having a contact angle with water of not less than 90° and the absolute value of a variation of the contact angel of within 2.0°. Contrary to that, in Photoreceptor 4 employing PTFE having an average primary particle diameter of 0.01 μm, the dispersed state of the fluororesin particles in the surface layer was degraded and the absolute value of a variation of contact angle was increased to 2.2°, and in the images formed by this photoreceptor, the dash marks and the image unevenness were formed, the color difference was raised and the sharpness was degraded. In Photoreceptor 5 using PTFE-5 having an average diameter of primary particles of 0.22 μm, the absolute value of a variation of contact angle was 2.3° and in the images formed by this photoreceptor, the dash marks and the image unevenness were caused and the color difference was increased. By Photoreceptor 9 in which the content of PTFE-1 in the surface layer (charge transfer layer 2) was reduced for lowering the contact angle to 88°, the dash marks and the image unevenness were considerably caused, the image density was lowered and the color difference was increased.

<<Evaluation 3-2>>

Evaluation 3-2 was carried out in the manner the same as in the foregoing Evaluation 3-1 except that the semiconductor laser of the exposing device was replaced by a light emission diode emitting light of wavelength of 430 nm. The results of the evaluation were almost the same as those of Evaluation 1.

<<Evaluation 3-3>>

Photoreceptors 13 to 16 were evaluated in the manner the same as in the foregoing Evaluation 3-1 except that the wavelength of light emitted from the semiconductor diode was changed to 480 nm. The results of the evaluation of Photoreceptors 13 to 16 are listed in Table 3-3.

TABLE 3-3

| Photoreceptor No. | CGM in CGL | CTM in CTL 1 and CTL 2 | Thickness of CTL 1 (μm) | Fluororesin particle in CTL 2 Kind | Particle size (μm) (**) | Crystallinity (%) | Adding amount (parts) | Contact angle (°) | Variation of contact angle (\|°\|) |
|---|---|---|---|---|---|---|---|---|---|
| 13 | CGM-2 | CTM-1 | 10 | PTFE-1 | 0.12 | 82.2 | 200 | 111 | 1.5 |
| 14 | CGM-3 | CTM-2 | 10 | PTFE-1 | 0.12 | 82.2 | 200 | 110 | 1.4 |
| 15 | CGM-4 | CTM-3 | 10 | PTFE-1 | 0.12 | 82.2 | 200 | 112 | 1.2 |
| 16 | CGM-1 | CTM-5 | 10 | PTFE-1 | 0.12 | 82.2 | 200 | 110 | 1.0 |

(**) Number average diameter of primary particles

<<Evaluation 3-3>>

Photoreceptors 13 to 16 were evaluated in the same manner as in Evaluation 1 except that the emission wavelength of semiconductor laser was changed to 480 nm. The results of the evaluation are listed in Table 3-4.

TABLE 3-4

| Photoreceptor No. | Sharpness | Image density | Dash mark | Image unevenness | Color difference |
|---|---|---|---|---|---|
| 13 | A | A | A | A | A |
| 14 | A | A | A | A | A |
| 15 | A | A | A | A | A |
| 16 | A | A | A | A | A |

Result in Table 3-4 shows that Photoreceptors 13 to 16 were improved in the image density, dash mark, image unevenness and color difference, and the sharpness was also high.

A toner and a developer employing the toner were prepared.

Preparation of Latex

A solution previously prepared by dissolving 7.08 g of anionic surfactant (sodium dodecylbenzenesulfonate: SDS) in 2,760 g of deionized water was put into a 5,000 ml separable flask on which a stirrer, a thermal sensor, a cooler and a nitrogen introducing device were attached. The interior temperature of the flask was raised by 80° C. while stirring at 230 rpm under nitrogen gas stream. On the other hand, 72.0 g Exemplified Compound 19 was added to monomer mixture composed of 115.1 g of styrene, 42.0 g of n-butyl acrylate and 10.9 g of methacrylic acid and dissolved by heating at 80° C. to form a monomer liquid.

The above monomer liquid was mixed with and dispersed in the foregoing surfactant solution by a mechanical dispersing machine having a circulation pass at the heated state to prepare emulsified particles having a uniform particle size. To the resultant emulsion, a solution prepared by dissolving 0.84 g of a polymerization initiator (potassium persulfate: KPS) was added and heated and stirred at 80° C. for 3 hours to form latex particles.

Moreover, a solution prepared by dissolving 7.73 g of the polymerization initiator (KPS) in 240 ml of deionized water was added to the resultant latex. After 15 minutes, a mixture of 383.6 g of styrene, 140.0 g of n-butyl acrylate, 36.4 g of methacrylic acid and 14.0 g of n-octyl-3-mercaptopropionic acid ester was dropped spending for 120 minutes. The latex was further stirred for 60 minutes after the completion of the dropping, and then cooled by 40° C. to obtain latex particles. The resultant latex particle was referred to as Latex 1.

Example of Toner Preparation

Preparation of Colored Particle 1

In 160 ml of deionized water, 9.2 g of sodium n-dodecylsulfate was dissolved. To the resultant solution, 20 g of carbon black Regal 330R, manufactured by Cabot Co., Ltd., was gradually added while stirring, and then dispersed by a dispersion machine CLEARMIX. The particle diameter of the above suspension was 112 nm in terms of weight average as a result of measurement by an electrophoretic light scattering photometer ESL-800, manufactured by Ootsuka Denshi CO., Ltd. The suspension was referred to as Colorant Dispersion 1.

After that, 1,250 g of Latex 1, 2,000 ml of deionized water and the above Colorant Dispersion 1 were put into a 5 liter four-mouth flask on which a thermal sensor, a cooler, a nitrogen introducing device and a stirrer were attached. After adjusting the temperature at 30° C., the pH of the liquid was adjusted to 10.0 by adding a 5 mole/liter solution of sodium hydroxide.

And then, a solution prepared by dissolving 52.6 g of magnesium chloride hexahydrate in 72 ml of deionized water was added to the above liquid spending 5 minutes at 30° C. while stirring. After standing for 2 minutes, the liquid was heated by 90° C. spending 5 minutes in a rate of 12° C./minute. In such the state, the particle size was measured by Coulter Counter TA-II, and a solution prepared by dissolving 115 g of sodium chloride in 700 ml of deionized water was added for stopping the particle growth at a time when the volume average particle diameter was reached at 4.3 μm. The liquid was further stirred at 85±2° C. for 8 hours for salting out/fusing the particles.

Thereafter, the liquid was cooled in a rate of 6° C./minute and hydrochloric acid was added for adjusting the pH to 2.0, and the stirring was stopped. The resultant colored particles was filtered/washed under the following condition, and then dried by air of 40° C. to obtain colored particles. The particles were referred to as Colored Particle 1.

Preparation of Colored Particles 2 through 11

Colored Particles 2 through 11 were prepared in the same manner as in Colored Particle 1 except that the preparation conditions relating to the salt out/fusion were varied as listed in Table 4-1.

TABLE 4-1

| Colored particle No. | Adding amount of magnesium chloride | Temperature raising rate | Salt out/Fusion Liquid temperature | Salt out/Fusion Holding time | Particle diameter at stop of growing (μm) |
|---|---|---|---|---|---|
| Colored Particle 1 | 52.6 g | 12° C./minute | 85 ± 2° C. | 8 hours | 4.3 |
| Colored Particle 2 | 52.6 g | 20° C./minute | 90 ± 2° C. | 6 hours | 4.3 |

TABLE 4-1-continued

| Colored particle No. | Adding amount of magnesium chloride | Temperature raising rate | Salt out/Fusion Liquid temperature | Salt out/Fusion Holding time | Particle diameter at stop of growing (μm) |
|---|---|---|---|---|---|
| Colored Particle 3 | 52.6 g | 5° C./minute | 90 ± 2° C. | 6 hours | 4.1 |
| Colored Particle 4 | 26.3 g | 12° C./minute | 85 ± 2° C. | 8 hours | 4.3 |
| Colored Particle 5 | 78.9 g | 12° C./minute | 85 ± 2° C. | 8 hours | 4.3 |
| Colored Particle 6 | 52.6 g | 12° C./minute | 85 ± 2° C. | 8 hours | 3.5 |
| Colored Particle 7 | 38.6 g | 12° C./minute | 85 ± 2° C. | 8 hours | 3.4 |
| Colored Particle 8 | 78.9 g | 12° C./minute | 85 ± 2° C. | 8 hours | 3.2 |
| Colored Particle 9 | 52.6 g | 12° C./minute | 85 ± 2° C. | 8 hours | 5.6 |
| Colored Particle 10 | 45.8 g | 12° C./minute | 85 ± 2° C. | 8 hours | 6.8 |
| Colored Particle 11 | 52.6 g | 12° C./minute | 85 ± 2° C. | 8 hours | 8.9 |

To each of the Colored Particles 1 through 11, 1 weight-% of hydrophobic silica (number average primary particles; 12 nm, hydrophobicity: 68), 1 weight-% of hydrophobic titanium oxide (number average primary particles: 20 nm, hydrophobicity: 63) were added and mixed by a Henschel mixer to prepare toners. These toners were referred to as Toners 1 through 11. The average particle diameter and the particle size distribution were measured and listed in Table 4-2.

The physical properties such as the average particle size and the particle size distribution were substantially the same even when the measurement was performed either with respect to the colored particle as the raw material of the tone or the tone (usually containing an external additive together with the colored particle).

TABLE 4-2

| Toner No. | Volume average particle diameter of 50% (Dv50) (μm) | Number average particle diameter of 50% (Dp50) (μm) | Dv50/Dp50 | Volume average particle diameter of accumulate of 75% (Dv75) (μm) | Number average particle diameter of accumulate of 75% (Dp75) (μm) | Dv75/Dp75 | Percentage of number of particles of 0.7 × Dp50 |
|---|---|---|---|---|---|---|---|
| Toner 1 | 4.6 | 4.3 | 1.07 | 4.1 | 3.8 | 1.08 | 7.8 |
| Toner 2 | 4.8 | 4.5 | 1.07 | 4.2 | 3.7 | 1.14 | 5.5 |
| Toner 3 | 4.4 | 4.0 | 1.10 | 4.0 | 3.4 | 1.18 | 8.2 |
| Toner 4 | 4.6 | 3.7 | 1.24 | 4.0 | 3.1 | 1.29 | 13.6 |
| Toner 5 | 4.7 | 4.3 | 1.09 | 4.1 | 3.6 | 1.14 | 6.3 |
| Toner 6 | 3.5 | 3.1 | 1.13 | 3.1 | 2.8 | 1.11 | 6.8 |
| Toner 7 | 3.8 | 3.4 | 1.12 | 3.3 | 2.7 | 1.23 | 12.4 |
| Toner 8 | 3.6 | 3.3 | 1.09 | 3.1 | 2.8 | 1.11 | 6.3 |
| Toner 9 | 5.8 | 5.3 | 1.09 | 5.1 | 4.5 | 1.13 | 8.4 |
| Toner 10 | 7.1 | 6.4 | 1.11 | 6.3 | 5.3 | 1.19 | 11.0 |
| Toner 11 | 9.3 | 8.8 | 1.06 | 7.9 | 6.9 | 1.14 | 6.3 |

Preparation of Developer

Developers 1 through 11 for evaluation were prepared by mixing 10 parts by weight of each of Toners 1 through 11 with 100 parts by weight of ferrite carrier of 45 μm covered with styrene-methacrylate copolymer.

<<Evaluation 4-1>>

Thus obtained photoreceptor and the developer were installed in the combination given in Table 4-3 into a Color printer available on the market MAGICOLOR 2200 Desk Laser, manufactured by Minolta QSM Co., Ltd., and subjected to durability test. The evaluation was carried out by printing of 20,000 sheets in total, in which an original picture including a solid image, a character image and a halftone image was printed at the initial print and every 5,000th prints. The items and the norms of the evaluation are described below.

The processing conditions in the above color printer were as follows.

Charging device: Saw tooth electrode

Exposing device: Semiconductor laser (Emission wavelength: 405 nm)

Development: Reversal development

Transfer: Intermediate transfer belt

Cleaning: Cleaning blade

Fixing: Thermal fixing

Processing speed: 100 mm/second

Image Density

The reflective density of the image was measured by a densitometer RD-918, manufactured by Macbeth Co., Ltd., the density was expressed by a relative value when the reflective density of the paper was set at 0. The image density was lowered accompanied with a lot of printing. The measurement was carried out for the black solid image of printed after 20,000 sheets of printing.

A: The density of the black solid image was not less than 1.2; good.

B: The density of the black solid image was from 1.0 to 1.2; no problem for the practical use.

C: The density of the black solid image was less than 1.0; a problem was posed in the practical use.

Fog

The reflective density of the white solid image was measured as the fog by D-918, manufactured by Macbeth Co., Ltd. The reflective density was evaluated by the relative density when the density of A4 size paper before printing was set at 0.000. The measurement was carried out at the white solid image printed after 20,000 sheets of printing.

A: The density was less than 0.010; good.

B: The density was from 0.010 to 0.020; the level on which no problem was caused in the practical use.

C: The density was more than 0.020; the level on which a problem was caused in the practical use.

Unevenness in Image

A: Any unevenness was not caused in the halftone image through 20,000 copies.

B: Slight stripe-shaped unevenness were observed on the photoreceptor surface but not observed at all in the halftone image.

C: Strip-shaped unevenness meeting with the damage on the photoreceptor surface was clearly observed on the entire surface of the halftone image during the 20,000 prints.

Image Blurring

A: No blur occurred at al through 20,000 prints, good.

B: Partially image blurring occurred on some prints (less than 10 sheets) among the 20,000 prints but no problem was caused in practical use.

C: Partially image blurring occurred on 10 or more prints or image blurring in wide area occurred on 1 or more prints among the 20,000 prints; a problem was caused in practical use.

Dash Mark

The occurrence state of the dash marks on the halftone image was judged according to the following norms.

A: No nucleus of dash mark was observed on the photoreceptor and no dash mark occurred on the halftone image; good.

B: Dash mark nuclei were observed on the photoreceptor but no dash mark occurred on the halftone image; no problem was caused in practical use.

C: Dash mark nuclei were observed on the photoreceptor and dash marks occurred on the halftone image; a problem was caused in the practical use.

Sharpness

Three halftone images each having dot density of 600 dpi (spot diameter: 50 nm), 1,200 dpi (spot diameter: 30 nm) and 2,400 dpi (spot diameter: 15 nm) were prepared for evaluating by varying the spot diameter of the laser beam.

Rank A: The halftone images of 600 dpi through 2,400 dpi were each clearly reproduced (the dots were independently reproduced): Image quality was excellent.

Rank B: The halftone images of 600 dpi and 1,200 dpi were each clearly reproduced, but the clarity (independency of the dots) in the halftone image of 2,400 dpi was insufficient: The image quality was good.

Rank C: The halftone image of 600 dpi was clearly reproduced, but the clarity (independency of the dots) in the halftone images of 1,200 dpi and 2,400 dpi was insufficient: The image quality was normal.

Rank D: The clarity (independency of the dots) in the halftone images of 600 dpi was insufficient: The image quality was insufficient.

TABLE 4-3

| Combination No. | Photoreceptor No. | Developer No. | Image density | Fog | Dash mark | Image unevenness | Image blurring | Sharpness |
|---|---|---|---|---|---|---|---|---|
| 1 | 1 | 1 | A | A | A | A | A | A |
| 2 | 1 | 2 | A | A | A | A | A | A |
| 3 | 1 | 3 | A | B | A | B | A | B |
| 4 | 1 | 4 | A | C | C | B | A | C |
| 5 | 1 | 5 | A | A | A | A | A | A |
| 6 | 1 | 6 | A | A | A | A | A | A |
| 7 | 1 | 7 | A | C | C | B | A | B |
| 8 | 1 | 8 | A | A | A | A | A | A |
| 9 | 1 | 9 | A | A | A | B | A | B |

TABLE 4-3-continued

| Combination No. | Photoreceptor No. | Developer No. | Image density | Fog | Dash mark | Image unevenness | Image blurring | Sharpness |
|---|---|---|---|---|---|---|---|---|
| 10 | 1 | 10 | A | C | C | B | B | B |
| 11 | 1 | 11 | B | B | B | B | A | B |
| 12 | 2 | 1 | A | A | A | A | A | A |
| 13 | 3 | 1 | A | A | A | A | B | B |
| 14 | 4 | 1 | B | A | C | B | B | C |
| 15 | 5 | 1 | B | A | C | B | C | C |
| 16 | 6 | 1 | B | A | A | A | B | B |
| 17 | 7 | 1 | B | A | C | C | A | C |
| 18 | 8 | 1 | A | A | B | A | A | B |
| 19 | 9 | 1 | B | A | C | C | A | C |
| 20 | 10 | 1 | A | A | A | A | A | A |
| 21 | 11 | 1 | B | A | A | B | B | B |
| 22 | 12 | 1 | B | A | B | B | A | B |
| 23 | 13 | 1 | A | A | A | A | A | A |
| 24 | 14 | 1 | A | A | A | A | A | A |
| 25 | 15 | 1 | A | A | A | A | A | A |
| 26 | 16 | 1 | A | A | A | A | A | A |

As is shown in Table 4-3, the combination of organic Photoreceptor No. 1 with each of Developers No. 1 to 3, 5 to 9 and 11, Combinations 1 to 3, 5 to 9 or 11, each gives good electrophotographic image improved in the unevenness, blur, dash mark and sharpness. Photoreceptor No. 1 contains the fluororesin particles having an average primary particle diameter of from 0.02 μm to less than 0.20 μm and the binder resin, and had the surface later (Charge transfer layer 2) a contact angle with water of not less than 90° and a absolute value of a variation of the contact angle of not more than 2.0°, Developers No. 1 to 3, 5 to 9 and 11 each contains the toner in which the number of the toner particle having the diameter not more than 0.7×(Dp50) was not more than 10% when the diameter of 50% in number of the toner particle is Dp50. The combination of Developer 1 satisfying the requirements of the invention and the organic photoreceptor containing the fluororesin fine particles having an average primary particle diameter of not less than 0.02 μm and less than 0.20 μm and a crystallinity of less than 90% and the binder resin and having a contact angle with water of not less than 90° and a absolute value of a variation of the contact angle of not more than 2.0°, namely Combinations No. 12, 13, 16, 18, 20 to 26, gave good electrophotographic images improved in the unevenness, blur, dash mark and sharpness. The fog and the dash marks were caused and the sharpness was lowered by Combination 4, and the degradation of the image quality caused by the occurrence of the fog and the dash marks were caused by Combinations 4, 7 or 10 each employing Developer No. 4, 7, or 10 each not satisfying the conditions of the invention even when these toners were each combined with Photoreceptor No. 1 satisfying the requirements of the invention such as Combination 4, 7, and 10.

On the other hand, the dash marks were caused by Combination 14 employing Photoreceptor 4 in which the fluororesin particles having an average primary particle diameter of 0.01 μm and the dispersibility of the fluororesin particle was not suitable and the absolute value of a variation of contact angle was as large as 2.2°. The dash marks and image blurring were caused and the sharpness was lowered by Combination No. 15 employing Photoreceptor 5 in which the fluororesin particles having an average primary particle diameter of 0.22 μm was used and the absolute value of a variation of contact angle was as large as 2.3°. The dash marks and image blurring were caused and the sharpness was lowered by Combination No. 17 employing Photoreceptor 7 in which the fluororesin particles having a crystallinity of 91.3% was used, and the spreading ability of the fluororesin particle was insufficient and the absolute value of a variation of contact angle was as large as 2.2°. The dash marks and image blurring were caused and the sharpness was lowered by Combination No. 19 employing Photoreceptor 9 in which the content of the fluororesin particle is reduced and the contact angle was as low as 88° and the absolute value of a variation of contact angle was as large as 2.4°. The dash marks and image blurring are caused and the sharpness were lowered by Combination No. 27 employing Photoreceptor 17 in which the charge transfer layer 2 was coated by an immersion coating apparatus and the absolute value of a variation of contact angle was as large as 2.6°.

<<Evaluation 4-2>>

The evaluation 4-2 was performed in the same manner as in Evaluation 4-1 except that the semiconductor laser of the exposing device was replaced by a light emission diode emitting light of 430 nm. The results of the evaluation were almost the same as those of Evaluation 4-1 even when the light emission diode was employed for the imagewise exposing light source.

<<Evaluation 4-3>>

The evaluation 4-3 was performed in the same manner as in Evaluation 4-1 except that the semiconductor laser emitting light of 405 nm of the exposing device was replaced by a semiconductor laser emitting light of 480 nm. The results of the evaluation were almost the same as those of Evaluation 4-1 even when the semiconductor laser emitting light of 480 nm was applied as the imagewise exposing light source.

The invention claimed is:

1. An image forming method comprising the steps of:

forming a latent image by irradiating an organic photoreceptor by light from a light source of a semiconductor laser or a light emission diode emitting light of a wavelength of from 350 to 500 nm, and developing the latent image by a developer containing a toner to form a toner image, wherein the organic photoreceptor has a surface layer comprising a binder and fluororesin fine particles having an average primary particle diameter of not less than 0.02 μm and less than 0.20 μm, and crystallinity of the fluororesin fine particles is less than 90% and not less than 40%.

2. The image forming method of claim 1, wherein the organic photoreceptor has the surface layer having a contact angle with water of not less than 90° and an absolute value of a variation of the contact angle of less than 2.0°.

3. The image forming method of claim 1, wherein the organic photoreceptor has a charge generation layer and a charge transfer layer on an electroconductive substrate, and the surface layer is the charge transfer layer.

4. The image forming method of claim 1, wherein the binder contains siloxane-modified polycarbonate.

5. The image forming method of claim 1, wherein the surface layer contains an anti-oxidation agent.

6. The image forming method of claim 1, wherein the organic photoreceptor has an inter layer between the charge generation layer and the electroconductive substrate, and the inter layer comprises a binder and N type semi-conductive fine particles.

7. The image forming method of claim 6, wherein the N type semi-conductive fine particles are metal oxide.

8. The image forming method of claim 6, wherein the N type semi-conductive fine particles are titanium oxide or zinc oxide.

9. The image forming method of claim 6, wherein the N type semi-conductive fine particles are rutile or anatase type titanium oxide.

10. The image forming method of claim 6, wherein the N type semi-conductive fine particles are treated with said surface modifier.

11. The image forming method of claim 1, wherein the organic photoreceptor has an inter layer between the charge generation layer and the electroconductive substrate, and the inter layer comprises a binder containing a polyamide resin.

12. The image forming method of claim 11, wherein the polyamide resin has a heat of fusion of from 0 to 40 J/g and a water absorption degree of not more than 5% by weight.

13. The image forming method of claim 6, wherein volume ratio of the binder resin to N type semi-conductive fine particles in the inter layer is 1-2 part of the N type semi-conductive fine particles per 1 part of the binder resin.

14. The image forming method of claim 1, wherein the toner comprises toner particles having a particle diameter below 0.7×(Dp50) being 10 number percents, wherein Dp50 is 50% number particle diameter.

15. The image forming method of claim 1, wherein the toner comprises toner particles having a ratio (Dv50/Dp50) being 1.0-1.15, wherein Dv50 is 50% volume particle diameter and Dp50 is 50% number particle diameter.

16. The image forming method of claim 1, wherein the toner comprises toner particles having a ratio (Dv75/Dp75) being 1.0-1.20, wherein Dv75 is 75% volume particle diameter and Dp75 is 75% number particle diameter.

* * * * *